US012281877B2

(12) United States Patent
Renaud et al.

(10) Patent No.: US 12,281,877 B2
(45) Date of Patent: Apr. 22, 2025

(54) FIREARM ACCESSORY MOUNTING ASSEMBLY, FIREARM CONTAINING THE SAME, AND METHOD OF ATTACHMENT

(71) Applicant: Muniec Arms, LLC, Ludlow, MA (US)

(72) Inventors: Gerald Renaud, Belchertown, MA (US); Wayne Tetrault, Granby, MA (US)

(73) Assignee: Muniec Arms LLC, Ludlow, MA (US)

( * ) Notice: Subject to any disclaimer, the term of this patent is extended or adjusted under 35 U.S.C. 154(b) by 0 days.

(21) Appl. No.: 18/350,215

(22) Filed: Jul. 11, 2023

(65) Prior Publication Data

US 2025/0020437 A1 Jan. 16, 2025

(51) Int. Cl.
*F41G 11/00* (2006.01)

(52) U.S. Cl.
CPC ..... *F41G 11/006* (2013.01)

(58) Field of Classification Search
CPC ..... F41G 11/005; F41G 11/006
See application file for complete search history.

(56) References Cited

U.S. PATENT DOCUMENTS 1,756,603 A * 4/1930 Noske ..... F41G 11/003 42/125
2,187,096 A * 1/1940 Pomeroy ..... F41G 1/26 42/137
2,306,972 A * 12/1942 Meisel ..... F41G 11/006 248/694
2,436,948 A * 3/1948 Williams ..... F41G 11/001 42/127
2,493,254 A * 1/1950 Leupold ..... F41G 11/006 42/126
2,743,525 A * 5/1956 Leupold ..... F41G 11/001 42/126
3,161,960 A * 12/1964 Badali ..... F41G 1/28 42/137
3,495,339 A * 2/1970 Elliason ..... F41G 1/26 42/137
3,662,469 A * 5/1972 Charron ..... F41G 1/26 42/137
4,353,180 A * 10/1982 Wilson ..... F41G 11/006 42/127
4,628,611 A * 12/1986 Ruffino ..... F41G 1/16 42/137

(Continued)

*Primary Examiner* — Derrick R Morgan
(74) *Attorney, Agent, or Firm* — DeLio Peterson & Curcio LLC; Robert Curcio

(57) ABSTRACT

A quick-attachment/quick-release firearm accessory mounting assembly releasably and rotatably attached to a firearm rail, chassis, or handgun slide to receive any of a number of different accessories, such as, a telescopic sight, reflector sight, laser sight, night vision sight, thermal scope, range finder, and other secondary instruments. The mounting assembly is in the form of an adaptor plate having attachment structures for receiving the accessory on a top surface, and securing to the firearm structure on a bottom surface. The firearm is modified to receive the adaptor plate, the firearm frame having a recess portion with a center protrusion in rotatable communication with a center aperture in the adaptor plate, and having grooves or slots formed at each end of the recess portion to receive flanges at each end of the adaptor plate upon rotation.

37 Claims, 20 Drawing Sheets

(56) References Cited

U.S. PATENT DOCUMENTS 6,082,012 A * 7/2000 McLeod ..... F41G 1/467 124/87
6,931,779 B1 * 8/2005 Galuppo, Jr. ..... F41G 11/001 42/114
7,987,623 B1 * 8/2011 Moody ..... F41G 11/003 42/71.01
8,468,735 B1 * 6/2013 Keng ..... F41G 1/08 42/148
8,793,921 B1 * 8/2014 Tonello ..... F41G 11/008 42/125
9,506,726 B2 11/2016 Wolf
9,587,911 B2 3/2017 Wolf
9,863,740 B2 1/2018 Wolf
10,605,565 B1 * 3/2020 Geissele ..... F41G 1/17
10,948,267 B2 * 3/2021 Zimmer ..... F41G 11/006
11,454,474 B2 * 9/2022 Zimmer ..... F41G 11/006
11,460,274 B2 * 10/2022 Dawson, Jr. ..... F41G 11/001
11,859,945 B1 * 1/2024 Kim ..... F41G 1/02
12,135,190 B2 * 11/2024 Zimmer ..... F41G 11/003
2003/0131518 A1 * 7/2003 Komberger ..... F41G 11/007 42/135
2008/0216380 A1 * 9/2008 Teetzel ..... F41G 11/003 42/127
2009/0065666 A1 * 3/2009 Maningo ..... F16M 11/10 248/178.1
2012/0085014 A1 * 4/2012 Riley ..... F41G 11/004 42/115
2013/0061511 A1 * 3/2013 Strayer ..... F41G 1/26 42/135
2013/0333263 A1 * 12/2013 Hovey ..... F41C 23/16 42/72
2015/0198421 A1 * 7/2015 Crispin ..... F41G 11/006 42/126
2015/0241175 A1 * 8/2015 Wolf ..... F41G 11/005 42/124
2016/0076853 A1 * 3/2016 Brown ..... F41G 3/16 89/41.17
2016/0216062 A1 * 7/2016 Trotabas ..... F41G 11/003
2017/0191798 A1 * 7/2017 Chu ..... F41B 5/12
2017/0261288 A1 * 9/2017 Bartoszewicz ..... F41G 11/003
2018/0017356 A1 * 1/2018 Cabrera ..... F41G 1/345
2018/0058816 A1 * 3/2018 Geissele ..... F41A 3/66
2018/0094767 A1 * 4/2018 McCoy, II ..... F41G 11/005
2018/0195835 A1 * 7/2018 Crispin ..... F41G 1/30
2019/0041162 A1 * 2/2019 Cabrera ..... F41G 1/17
2019/0145731 A1 * 5/2019 Stewart ..... F41C 27/00 42/90
2019/0331461 A1 * 10/2019 Zimmer ..... F41G 1/17
2020/0326157 A1 * 10/2020 Curry ..... F41A 21/484
2021/0199409 A1 * 7/2021 Zimmer ..... F41G 11/003
2021/0254933 A1 * 8/2021 Langdon ..... F41G 11/001
2021/0270572 A1 * 9/2021 Dawson, Jr. ..... F41G 11/001
2021/0318099 A1 * 10/2021 Holly ..... F41G 11/002
2023/0011632 A1 * 1/2023 Salinas ..... F41G 1/30
2023/0114998 A1 * 4/2023 Carter ..... F41G 11/008 42/124
2023/0117500 A1 * 4/2023 Dawson, Jr. ..... F41G 11/001 42/111
2023/0135474 A1 * 5/2023 Fackler ..... F41G 11/007 42/111
2023/0168068 A1 * 6/2023 Fackler ..... F41G 11/003 42/124
2023/0184517 A1 * 6/2023 Davis ..... F41G 1/02 42/90
2023/0228530 A1 * 7/2023 Dawson, Jr. ..... F41G 11/001 42/111
2024/0110767 A1 * 4/2024 Underwood ..... F41G 11/003
2024/0110769 A1 * 4/2024 Underwood ..... F41G 11/003
2024/0191972 A1 * 6/2024 Elpedes ..... F41G 11/001
2024/0200908 A1 * 6/2024 Fuller ..... F41G 1/30
2024/0240916 A1 * 7/2024 Forestieri, Sr. ..... F41G 1/467

* cited by examiner

FIREARM ACCESSORY MOUNTING ASSEMBLY, FIREARM CONTAINING THE SAME, AND METHOD OF ATTACHMENT

BACKGROUND OF THE INVENTION

1. Field of the Invention

A quick-attachment/quick-release firearm accessory mounting assembly is disclosed herein. The mounting assembly is releasably and rotatably attached to a firearm rail, chassis, or handgun slide to receive any of a number of different accessories, such as, for example, a telescopic sight, reflector sight, laser sight, night vision sight, thermal scope, range finder, and other secondary instruments. The mounting assembly is in the form of an adaptor plate or platform having attachment structures for receiving the accessory on a top surface, and securing to the firearm structure on a bottom surface. In an exemplary embodiment, a pistol slide top surface is modified to receive an adaptor plate. Traditionally, these accessories are attached directly to a mounting structure on the firearm, such as a scope mount or rail.

2. Description of Related Art

Numerous add-on enhancements have become available for accessory attachment to standard firearms, thereby significantly upgrading the capability of the firearm. Firearms, such as pistols, rifles, among others, generally include one or more mounting support structures, such as a rail, chassis, or slide. Typically, the mounting support structures are used to receive sights, range finders, and the like, generally to allow the shooter to aim and shoot more accurately. In general, accessories to firearms are physically mounted using bolts, adjustor plates, cammed levers, friction holds, and other mechanisms; however, such mounting schemes can be time-consuming to attach and remove.

When mounted on a firearm, a sighting accessory is necessarily offset from the firearm barrel, which introduces difficulty for sighting alignment. For example, a laser sight is typically mounted such that the laser beam extends generally parallel to, but offset from, the initial flight path of the projectiles. At close distances, the offset can result in a significant targeting error since the laser beam cannot be coaxial with the barrel. Consequently, there remains a need to accommodate the height offset of a sighting accessory relative to the barrel.

Furthermore, replacing one accessory with another can be a time-consuming endeavor since attachment bolts must be removed, and then replaced for a different accessory. Field replacement becomes, at best, cumbersome and difficult.

In U.S. Pat. No. 9,506,726 titled "ACCESSORY MOUNTING FOR FIREARMS", issued on Nov. 29, 2016, a firearm mounting surface is presented that includes a recess formed on the topside of a slide of a pistol. The recess includes mounting posts extending upwards from the slide for attachment to a plurality of sights having matching openings and fasteners. A mounting plate, sized to fit within the recess, is configured with through-hole apertures to receive the mounting posts attached to, and extending from, the slide recess top surface. The mounting posts extend upwards from the slide top surface and include a center threaded opening formed coaxial with each post. This allows a threaded screw to attach through an accessory bottom surface into the mounting post. The slide recess further includes projections extending upwards for mating with indentations in the mounting plate—the indentations extending inwards from the outer lateral edges of the mounting plate to receive the projections formed in the recess top surface. The projections fit within the indentations on the mounting plate and fix the mounting plate to the slide, such that the mounting plate cannot shift within the slide recess, i.e., cannot shift or rotate about the slide. The mounting posts secure the plate from upward detachment from the slide.

SUMMARY OF THE INVENTION

Bearing in mind the problems and deficiencies of the prior art, it is therefore an object of the present invention to provide a firearm with the capability of quickly attaching and removing an accessory with minimum structural attachment components.

It is another object of the present invention to provide a removable, rotatable adaptor plate for mounting on one side to a firearm frame, and on the other side to a firearm accessory.

It is another object of the present invention to provide a removable rotatable adaptor plate that can be readily secured to a firearm frame upon completion of rotation.

A further object of the invention is to provide a pistol having a modified pistol slide capable of receiving a rotatable, releasable adaptor plate that can mount a firearm accessory.

It is yet another object of the present invention to provide a firearm with a mountable, removable, interchangeable accessory structure.

Still other objects and advantages of the invention will in part be obvious and will in part be apparent from the specification.

The above and other objects, which will be apparent to those skilled in the art, are achieved in the present invention which is directed to a rotatable accessory mounting assembly for rotatably mounting a firearm accessory to a firearm body, the mounting assembly comprising: an adaptor plate having a top surface, a bottom surface, longitudinal sides, lateral sides shorter than the longitudinal sides, the adaptor plate including: at least one locator stud aperture dimensioned for receiving a locator stud or mounting post; a center aperture for providing a pivot location for the rotatable adaptor plate, the center aperture located adjacent the at least one locator stud aperture, and approximately centered about the adapter plate; a forward facing flange forming one edge of the adaptor plate; and a breech facing flange forming an opposite edge of the adaptor plate.

The adaptor plate further including a through-hole aperture adjacent the forward facing flange or the breech facing flange.

On the adaptor plate bottom surface is a nonround recess centered about each of the at least one locator stud apertures; and an annular recess concentric with the center aperture, and larger in diameter than the center aperture, the annular recess dimensioned to receive an O-ring.

The firearm accessory mounting assembly further includes: at least one locator stud for insertion within each of the at least one locator stud apertures, the locator stud having a nonround head for non-rotational placement within the nonround recess and a threaded post; and at least one locator sleeve for attachment to the threaded post of the at least one locator stud, such that each of the at least one locator studs is secured to the adaptor plate prior to rotational placement of the adaptor plate on a firearm structure.

An O-ring may be situated within the annular recess concentric with the center aperture.

The adaptor plate may include a forward facing sidewall, the forward facing sidewall located adjacent the forward facing flange, and/or a breech facing sidewall, the breech-facing sidewall located adjacent the breech facing flange. The forward facing sidewall and/or the breech facing sidewall may include a cut-out portion or gap.

The firearm accessory mounting assembly may further include a through-hole aperture adjacent the forward facing flange or the breech facing flange, such that the through-hole aperture traverses through at least a portion of the forward facing sidewall or the breech facing sidewall.

The bottom surface of the adaptor plate may include a recessed ramp having sidewalls and a top wall, the recessed ramp extending in continuously decreasing depth from the longitudinal side, projecting laterally inwards towards the through-hole aperture.

The ramp may extend laterally inwards, such that the recessed ramp initiates at an opening at the longitudinal sidewall, the recessed ramp having gradually decreasing depth as the recessed ramp progresses laterally inwards, such that the recessed ramp top wall approximately abuts the adapter plate bottom surface.

The forward facing sidewall or the breech facing sidewall may include: a release lever pocket traversing laterally across the forward facing sidewall or the breech facing sidewall; and a release lever rotatably insertable within the release lever pocket.

For accessory attachment purposes, the firearm accessory mounting assembly may include at least one protrusion or lug extending upwards from the adaptor plate top surface, the at least one protrusion or lug located closer to an edge of the adaptor plate.

In a second aspect, the present invention is directed to a pistol slide for receiving a rotatable accessory mounting assembly, the pistol slide having a top surface, longitudinal sides, and lateral sides shorter than the longitudinal sides, the pistol slide comprising: a recess portion having a planar top surface situated lower than the pistol slide top surface, and interrupted by an approximately centered circular cylinder or disc-shaped protrusion extending from the slide recess portion top planar surface; at least one aperture or recessed indentation located within the recess portion top planar surface; a groove or slot formed at an end of the recess portion, the groove or slot extending laterally across the slide; and an overhang or lip extending inwards within the recess portion, towards the circular cylinder or disc-shaped protrusion, forming a top shelf for the groove or slot.

The at least one aperture or recessed indentation forms an eyelet having two overlapping or interconnecting circular apertures including first and second circular apertures.

The pistol slide further includes a locking plunger pin having a pin head and a shoulder portion, the locking plunger pin received by the first circular aperture, and a low head screw received by the second circular aperture, such that a low rising head on the low head screw retains the shoulder portion of the locking plunger pin, allowing only the locking plunger pin head to be exposed above the recess portion top planar surface. A compression spring is in mechanical communication with the locking plunger pin, such that the locking plunger pin is responsive to the compression spring applying an upwards force towards the recess portion top planar surface.

In a third aspect, the present invention is directed to a firearm comprising: a frame having a top surface, longitudinal sides, and lateral sides shorter than the longitudinal sides; a barrel and receiver assembly; a recess portion in the frame having a planar top surface situated lower than the frame top surface, and interrupted by either an approximately centered circular cylinder or disc-shaped protrusion extending from the recess portion top planar surface, or an approximately centered cylindrically-shaped recess within the top planar surface; at least one aperture or recessed indentation located within the recess portion top planar surface; an overhang or lip extending inwards within the recess portion forming a top shelf for a groove or slot formed at an end of the recess portion, the groove or slot extending laterally across the frame; and an adaptor plate having a top surface, a bottom surface, longitudinal sides, lateral sides shorter than the longitudinal sides, the adaptor plate including: at least one locator stud aperture dimensioned for receiving a locator stud or mounting post; either a center aperture for providing a pivot location for the rotatable adaptor plate, the center aperture located adjacent the at least one locator stud aperture, such that the center aperture is approximately centered about the adaptor plate, the center aperture in rotatable communication with the circular cylinder or disc-shaped protrusion extending from the recess portion top planar surface, such that the adaptor plate is rotatable about the recess portion of the frame, or an approximately centered circular cylinder or disc-shaped protrusion extending from the adaptor plate bottom surface configured to be received by the approximately centered cylindrically-shaped recess within the top planar surface, such that the adaptor plate is rotatable about the recess portion of the frame; a forward facing flange forming one edge of the adaptor plate, or a breech facing flange forming an opposite edge of the adaptor plate, or both; and the forward facing and/or breech facing flanges respectively insertable within the groove or slot formed at a respective end of the recess portion upon rotation of the adaptor plate.

In a fourth aspect, the present invention is directed to a method of attaching a firearm accessory to a firearm, the method comprising: attaching the firearm accessory to a rotatable adaptor plate, the adaptor plate having an aperture or a circular- or disc-shaped protrusion configured for pivoting; placing the adaptor plate into a recess portion of a frame of the firearm, the recess portion having a complementary circular- or disc-shaped protrusion extending upwards from the recess portion for receiving the adaptor plate aperture, or a complementary aperture recessed within a planar surface of the recess portion for receiving the adaptor plate circular- or disc-shaped protrusion; pivoting the adaptor plate about the recess portion, thereby rotating a forward facing and breech facing flange of the adaptor plate into receiving grooves or slots formed at each end of the recess portion, the receiving grooves or slots having an overhang or lip extending inwards with respect to the recess portion.

In a fifth aspect, the present invention is directed to a method of attaching a firearm accessory to a firearm, the method comprising: placing an adaptor plate onto a recess portion of a frame of the firearm, the adaptor plate including: a top surface, a bottom surface, longitudinal sides, lateral sides shorter than the longitudinal sides; at least one locator stud aperture dimensioned for receiving a locator stud or mounting post, the at least one aperture located closer to a first edge of the adaptor plate; at least one protrusion or lug extending upwards from the adaptor plate top surface, the at least one protrusion or lug located closer to a second edge of the adaptor plate opposite the first edge; a center aperture for providing a pivot location for the rotatable adaptor plate, the center aperture located adjacent the at least one aperture and at least one protrusion or lug, such that the center aperture is approximately centered about the adaptor plate; a forward facing flange forming one edge of the adaptor plate; and a breech facing flange forming an opposite edge of the adaptor plate; pivoting the adaptor plate about the center aperture when the adaptor plate is placed within the recess portion of the firearm frame, and the center aperture is in rotatably communication with a circular cylinder or disc-shaped protrusion extending from a top planar surface of the recess portion; sliding the forward facing and the breech facing flanges into a groove or slot formed at each end of the recess portion, the groove or slot extending laterally across the frame, having a curvature, and having an overhang or lip extending inwards within the recess portion, towards the circular cylinder or disc-shaped protrusion, forming a top shelf for the groove or slot; and attaching the firearm accessory to the adaptor plate either before the adaptor place is placed onto the recess portion, or afterwards.

In a sixth aspect, the present invention is directed to a firearm recess portion filler comprising a rotatable adaptor plate having a top surface, a bottom surface, longitudinal sides, lateral sides shorter than the longitudinal sides, the rotatable adaptor plate including: a center circular recess or a circular-shaped protrusion on the rotatable adaptor plate bottom surface for providing a pivot location for the rotatable adaptor plate; a forward facing flange forming one edge of the rotatable adaptor plate; and a breech facing flange forming an opposite edge of the rotatable adaptor plate; wherein the rotatable adaptor plate top surface forms part of the firearm top surface.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
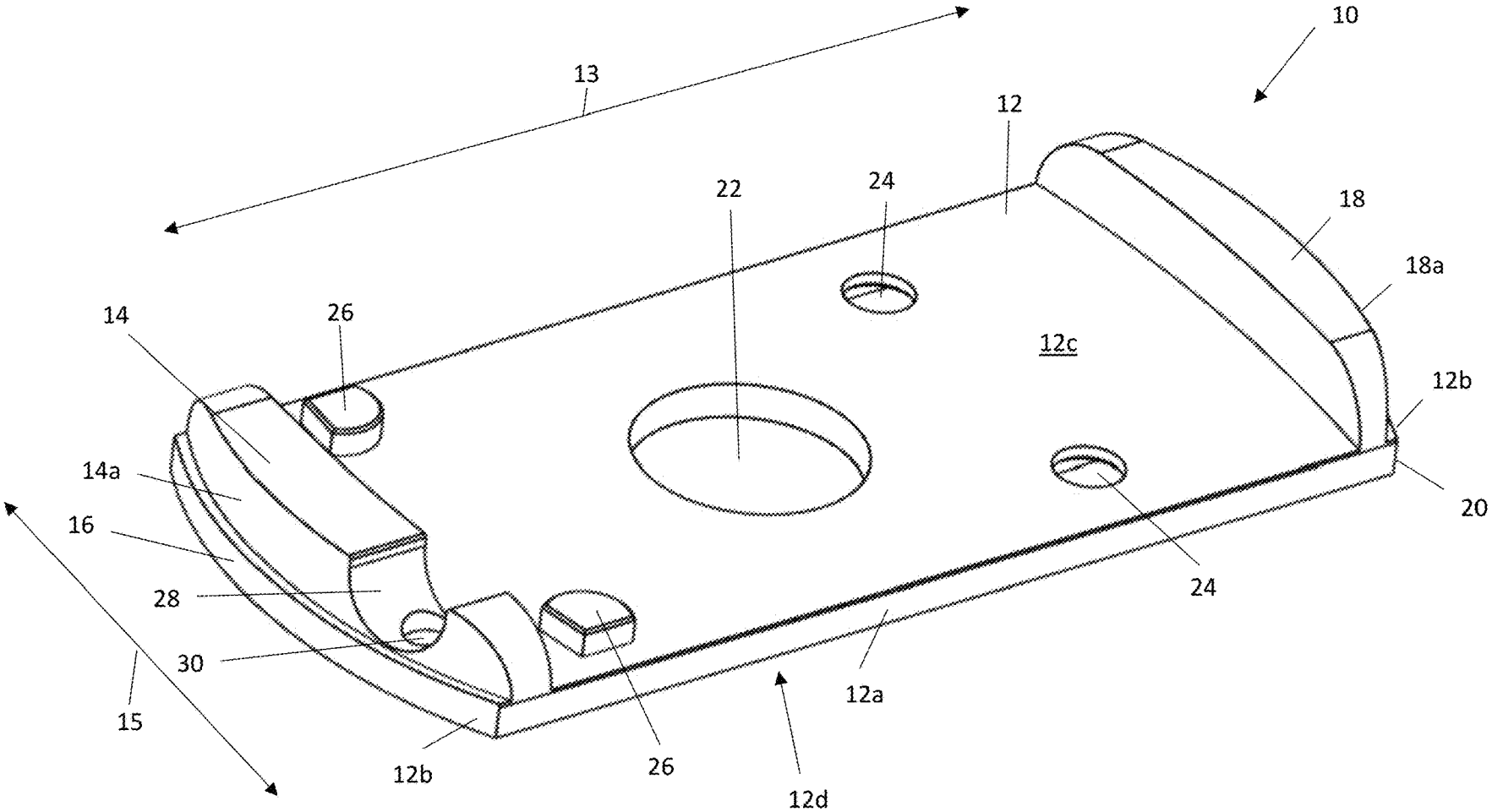
FIG. 1 depicts a top prospective view of one embodiment of a rotatable mounting platform or adaptor plate of the present invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc., may be used herein to describe various components, these components should not be limited by these terms. These terms are only used to distinguish one component from another. For example, a first element could be termed a second element, and, similarly, a second element could be termed a first element, without departing from the scope of the present invention.

As used herein, the singular forms "a", "an" and "the" are intended to include the plural forms as well, unless the context clearly indicates otherwise. Also, as used herein, the term "and/or" includes any and all combinations of one or more of the associated listed items. It will be further understood that the terms "include" and/or "including" when used herein, specify the presence of stated features, steps, operations, elements, and/or components, but do not preclude the presence or addition of one or more other features, steps, operations, elements, components, and/or groups thereof.

Relative terms such as "below," "above," "upper," "lower," "horizontal," "vertical," "top," "bottom," "rear," "front," "side," or the like may be used herein to describe a relationship of one element or component to another element or component as illustrated in the figures. It will be understood that these terms are intended to encompass different orientations of the device in addition to the orientation depicted in the figures.

Additionally, in the subject description, the words "exemplary," "illustrative," or the like are used to mean serving as an example, instance or illustration. Any aspect or design described herein as "exemplary" or "illustrative" is not necessarily intended to be construed as preferred or advantageous over other aspects or design. Rather, use of the words "exemplary" or "illustrative" is merely intended to present concepts in a concrete fashion.

In describing the preferred embodiment of the present invention, reference will be made herein to FIGS. 1-20 of the drawings in which like numerals refer to like features of the invention.

The present invention generally relates to after-market modifications to certain types of firearms to accommodate accessories that enhance the firearm's performance. In this regard, an embodiment of the invention is directed to an accessory attachment system for connecting an accessory to a modern-style firearm, such as a handgun slide assembly. In the case of the modern-style handgun, the slide mechanism is primarily comprised of an inverted U-shaped steel shell having precision-machined tips that match channel rails machined into the bottom handle assembly. The topside of the slide mechanism is generally adapted to receive and support an accessory. In a preferred embodiment, the topside of the slide mechanism is modified to receive an attachable, rotatable, mounting platform or adaptor plate made of rigid material, which may be metal or metal alloy. (The terms "mounting platform" and "adaptor plate" are used interchangeably herein.) The slide is modified to allow the adaptor plate to rotate to a secure position upon completion of rotation, such that the adaptor plate does not move once secured. Movement is restricted both in the rotational direction as well as in an upward direction perpendicular to the longitudinal direction of the slide, i.e., perpendicular to the barrel axis. The accessory mounting assembly incorporates structural forms and/or hardware to secure the adaptor plate to the pistol side top surface on one side, and to secure an accessory to the platform on the other side.

The accessory mounting assembly is configured as a releasably attachable, rotatable platform or adaptor plate, formed on one side to fit and attach to a firearm rail, chassis, or pistol slide, and on the other side—the "top side"—mounting structures are presented for receiving firearm accessories. Structures are defined for securing the mounting assembly such that the firearm receiving surface is capable of accepting and securing the platform or adaptor plate from movement after attachment. It is possible for the adaptor plate to receive more than one accessory, and the present invention is not limited to one accessory per adaptor plate. For illustrative purposes, however, the present description shall refer to an adaptor plate as receiving a single accessory without limiting the scope of the invention having an adaptor plate being able to receive a plurality of accessories.

FIG. 1 depicts a top prospective view of one embodiment of a rotatable mounting platform or adaptor plate 10 of the present invention. (For ease of description, mounting platform or adaptor plate 10 shall be referred to herein as adaptor plate 10.) Adaptor plate 10 includes a base section 12 that in one embodiment is generally rectangular in shape, having long or longitudinal sides 12*a* extending in a longitudinal direction in the direction of arrow 13, and shorter or lateral sides 12*b* extending in lateral direction in the direction of arrow 15, perpendicular to the longitudinal direction. Adaptor plate 10 has a predetermined thickness gauged for structural integrity and for restricting or assisting the overall height of the attached accessory. Adaptor plate 10 includes modifications to its top surface 12*c* and bottom surface 12*d* for attachment purposes as discussed further herein.

Adaptor plate base section 12 includes apertures and protrusions to assist in securing an accessory to the adaptor plate. In at least one illustrative embodiment, a raised forward sidewall 14 extends perpendicularly upwards from adaptor plate base section 12; forward sidewall 14 being recessed from the forward end of adaptor plate 10 such that a forward facing flange 16 is formed by the adaptor plate edge extending forward in the longitudinal direction beyond forward face 14*a* of forward sidewall 14. Similarly, a raised breech sidewall 18 extends perpendicularly upwards from adaptor plate base section 12; breech sidewall 18 being disposed inwards from the aft or breech end of adaptor plate 10 such that a breech facing flange 20 is formed by the adaptor plate edge extending outwards in a longitudinal direction relative to the aft or breech face 18*a* of sidewall 18. As will be shown in greater detail below, once adaptor plate 10 is rotated into place within the slide recess portion, flanges 16, 20 are used to secure adaptor plate 10, and thus adaptor plate base section 12, from any upwards movement away from the firearm mounting structure, such as a pistol slide.

In at least one embodiment, it is possible for the adaptor plate to be employed without forward and breech sidewalls. Each lateral end of the adaptor plate (forward and breech end) will still act as extended portions of the adaptor plate that function in the same manner as the aforementioned flanges, for attachment support within a modified pistol slide recess portion.

In the embodiment depicted in FIG. 1, an aperture 22, located at an approximate center of adaptor plate base section 12, acts to receive a pivot element, such as a circular cylinder or disc-shaped protrusion, extending upwards from a top surface of a slide recess portion (not shown), allowing the adaptor plate 10 to rotate about the slide. Aperture 22 need not be a complete through-hole in adaptor plate 10; rather, in at least one embodiment it is possible for the aperture to be exposed only on the bottom surface 12*d* of adaptor plate 10, provided the adaptor plate is sufficiently thick, and the aperture depth is adequate to receive the pivot element extending from the slide recess top surface. Aperture 22 is used in conjunction with the pivot element extending upwards from the top surface of the slide recess portion to form a rotational pivoting motion for the adaptor plate 10 about the slide.

Figure 2:
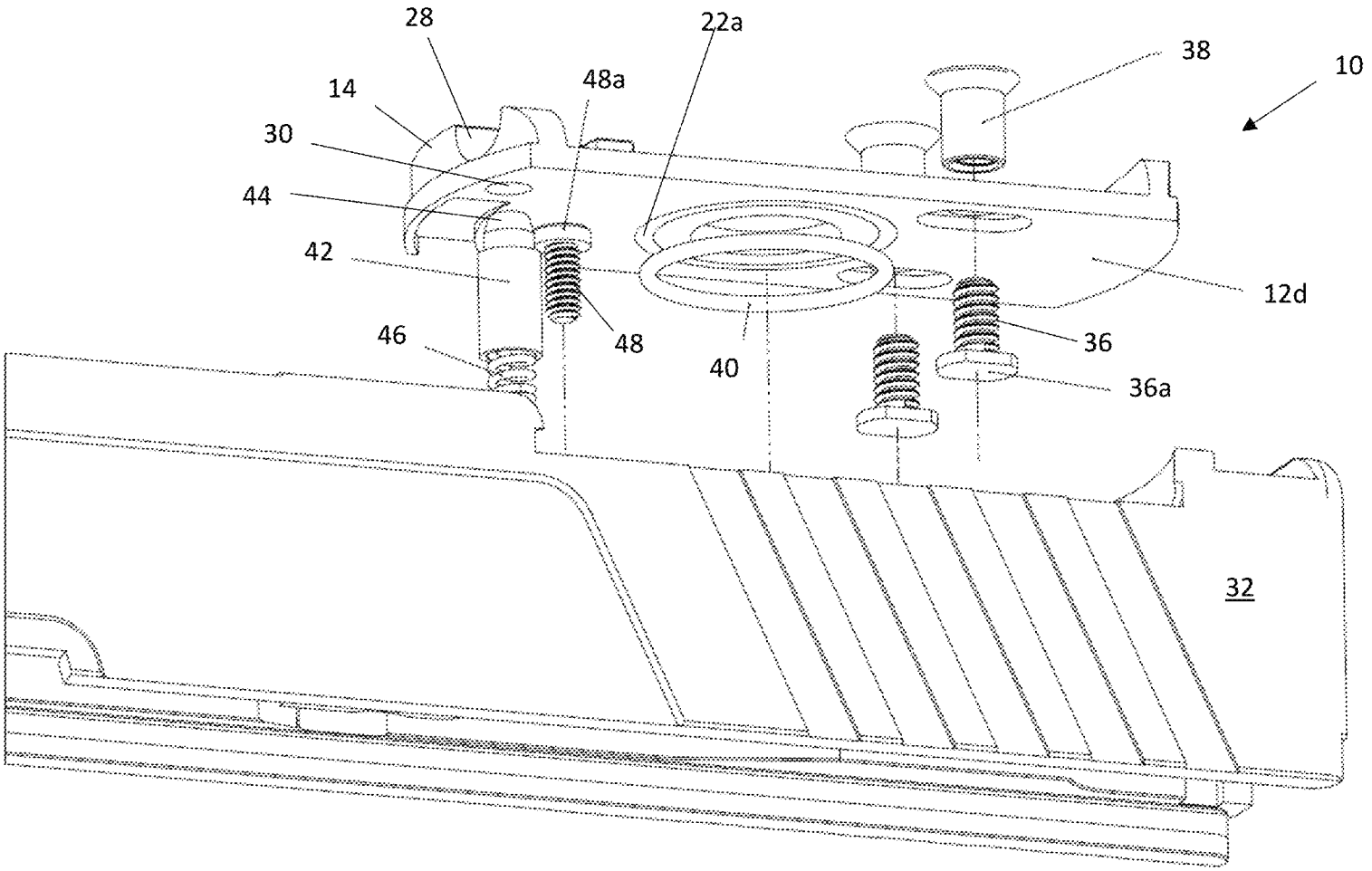
FIG. 2 depicts an exploded, upward perspective view of one embodiment of the accessory mounting assembly of the present invention, showing the bottom surface of the adaptor plate of FIG. 1, and the assembly mechanism of the adaptor plate on a pistol slide.

At least one locator stud aperture 24 is situated through adaptor plate 10, shown in the embodiment of FIG. 1 as two locator stud apertures, which may be located between aperture 22 and breech facing sidewall 18. Locator stud apertures 24 are spaced apart from one another. These are through-holes for receiving mounting structures, such as locator studs, to assist in securing an accessory to adaptor plate 10. As depicted in FIGS. 1 and 2, locator stud apertures 24 are spaced apart from one another in the lateral direction, shown in the illustrative embodiment being distanced approximately the length of the diameter of aperture 22, and placed adjacent the longitudinal sides 12*a*, respectively.

In order to ensure that an accessory, once attached, does not exhibit undesirable rotation relative to the adaptor plate 10, in concert with the locator studs at least one lug or protrusion 26, located between aperture 22 and forward sidewall 14, can be used to interlock with a complementary indentation or receiving aperture on an accessory bottom surface. Two lugs or protrusions are generally employed on the adaptor plate for this purpose. The interlocking of the at least one lug or protrusion 26 with the complementary indentation or receiving aperture on the accessory bottom surface prohibits the accessory from rotation about adaptor plate 10 once the accessory is secured to the adaptor plate. The shape, number, and placement of lugs or protrusions 26 may vary depending upon the complementary indentations or receiving apertures in the bottom surface of the accessory. It is envisioned that an adaptor plate may be dedicated to a certain accessory or set of accessories, such that the shape and placement of lugs or protrusions 26 are aligned with the given suite of accessories. Lugs or protrusions 26 are separated, adjacent each lateral side of the adaptor plate, and assist in prohibiting the attached accessory from lateral rotation with respect to the adaptor plate.

According to one attachment scheme of the present invention, in order to lock adaptor plate 10 into place in the pistol slide, such that rotation is prohibited, the adaptor plate is designed to receive a locking plunger pin head extending from the pistol slide, as discussed further below. Sidewall 14 includes a cutout portion or gap 28, along with exposed through-hole 30 at the bottom of the cutout portion configured to receive a locking plunger pin, which when extended into through-hole 30 prohibits rotational movement of adaptor plate 10. Cutout portion 28 is depicted as semi-circular in shape; however, other shaped cutouts or gaps are not prohibited. Moreover, sidewall 14 may be shorter, segmented, or truncated, such that through-hole 30 is exposed.

The height of each sidewall may be dimensioned for aesthetic purposes, so that the top of the sidewall is planar with the top surface of the slide. In another embodiment, through-hole 30 may be formed in said adaptor plate without an accompanying sidewall, such that the sidewall is eliminated and only the through-hole is exposed for receiving the locking plunger pin. The function of through-hole 30, as described herein, is not altered if a sidewall is not present. Furthermore, the placement of through-hole 30 is dependent upon the location of the locking mechanism in relation to the receiving structure on the firearm (pistol slide), placing the through-hole aperture on either the forward-facing side of the adaptor plate or the breech facing side, and the present invention is not regulated to any one location over the other.

FIG. 2 depicts an exploded, upward perspective view of one embodiment of the accessory mounting assembly of the present invention, showing the bottom surface 12*d* of adaptor plate 10, and the assembly of adaptor plate 10 on a pistol slide 32. The bottom surface 12*d* of adaptor plate 10 includes indentations 34 about locator stud apertures 24. These indentations form recesses centered approximately about the locator stud apertures 24. Indentations 34 are preferably nonround to receive locator studs 36 having complementary nonround heads 36*a*. This configuration allows the locator studs to remain stationary after the adaptor plate is placed on the pistol slide, when locator sleeves 38 are removed and when the accessory is attached.

Figure 3:
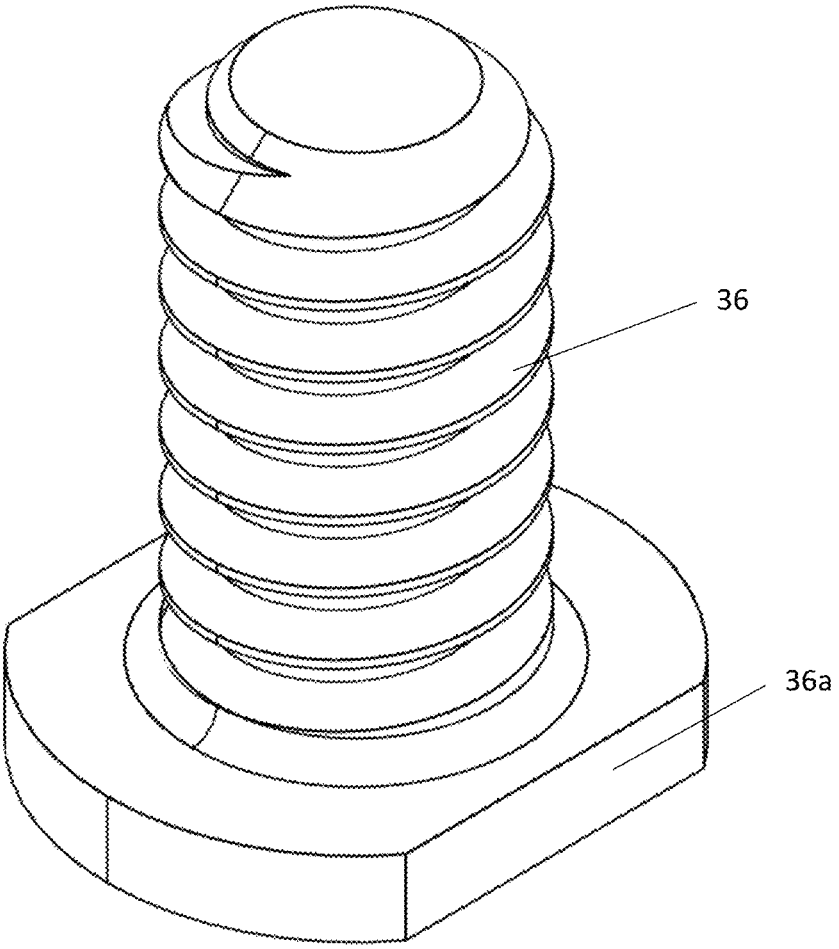
FIG. 3 depicts a top perspective view of threaded locator stud with a nonround head.

FIG. 3 depicts a top perspective view of threaded locator stud 36 with nonround head 36*a*. (In its assembled configuration, the locator stud has the threaded portion facing upwards.) Indentations 34 act as captured recesses for the locator stud nonround heads 36*a*. The attachment of locator studs 36 to adaptor plate 10 using locator sleeves 38 allows the adaptor plate 10 to have the locator studs 36 initially secured prior to the rotatable attachment of the adaptor plate. This ensures locator studs 36 will be available for an accessory attachment when the adaptor plate rotated into place on pistol slide 32, and locator sleeves 38 are removed so that the locator studs will accept the accessory. Indentations 34 capture locator stud heads 36*a* such that attachment of either the locator stud sleeves 38 or a separate attachment nut from the accessory can be threadingly secured without the locator stud rotating.

As shown in FIG. 2, O-ring 40 is insertable within an annular recess on the bottom surface 12*d* of adaptor plate 10, and provides a resilient attachment for the pivoting motion of the adaptor plate 10 about the pivot element, shown in the figures as a circular cylinder, or disc-shaped protrusion, extending from the slide recess top surface. O-ring 40 comprises resilient material, which ensures a snug-fit for the pivoting adaptor plate about the pivot element extending from the slide recess top surface, and a check against unwarranted vibration.

Figure 4:
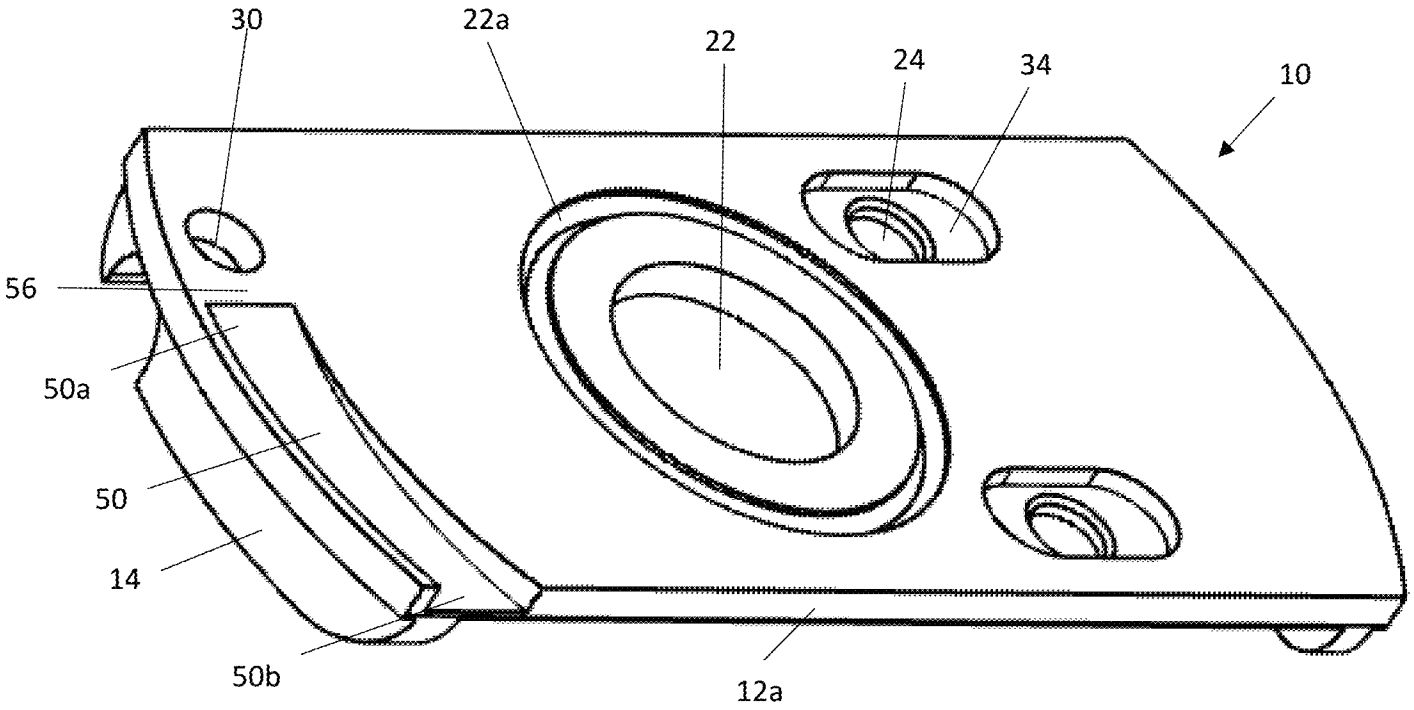
FIG. 4 depicts a bottom perspective view of the adaptor plate of FIG. 1 with an annular recess concentric with an aperture approximately centered about the adaptor plate, where the annular recess is dimensioned to receive an O-ring.

FIG. 4 depicts a bottom perspective view of the adaptor plate 10 of FIG. 1. The bottom surface of adaptor plate 10 at aperture 22 forms an annular recess 22*a* that is larger in diameter than aperture 22 to receive O-ring 40. O-ring 40 is preferably dimensioned to have an inner diameter that is equal to or slightly smaller than the pivot element extending from the slide recess top surface, such that any extraneous movement or vibration of adaptor plate 10 is dampened and further deterred during firing of the firearm. Upon completing rotation of adapter plate 10 onto the slide, a locking mechanism is employed to secure the adaptor plate from further rotation and/or extraneous movement.

Aperture 22 is concentric with annular recess 22*a*, which is dimensioned to receive O-ring 40. Locator stud apertures 24 are shown approximately centered about indentations 34, which in turn provide a recess for locator stud head 36*a* (not shown). At the forward end of adaptor plate 10 is through-hole 30, and adjacent thereto is a recessed ramp 50. Ramp 50 extends in a continuously decreasing depth from longitudinal side 12*a*, projecting laterally inwards towards through-hole 30. The largest depth coincides with the opening 50*b* at one longitudinal side 12*a*. The depth of ramp 50 gradually decreases as the ramp extends inwardly towards through-hole 30, such that ramp 50 has no appreciable depth at its inward-most distance 50*a* from its origin 50*b* at the longitudinal side wall. The purpose of ramp 50 is to provide an operational downwards directing force to a spring-actuated locking plunger pin 42 during rotation of adaptor plate 10 into locking position.

Ramp 50 is designed and configured to accept the head of spring-actuated locking plunger pin 42 upon rotation of adaptor plate 10. As depicted in FIG. 2, locking plunger pin 42 is biased in an upwards direction relative to the top surface of the slide by compression spring 46 or other resilient component capable of imparting an upwards force on the locking plunger pin. The "upwards" direction being defined as the direction perpendicular to, and away from, the top surface of slide 32.

Figure 5:
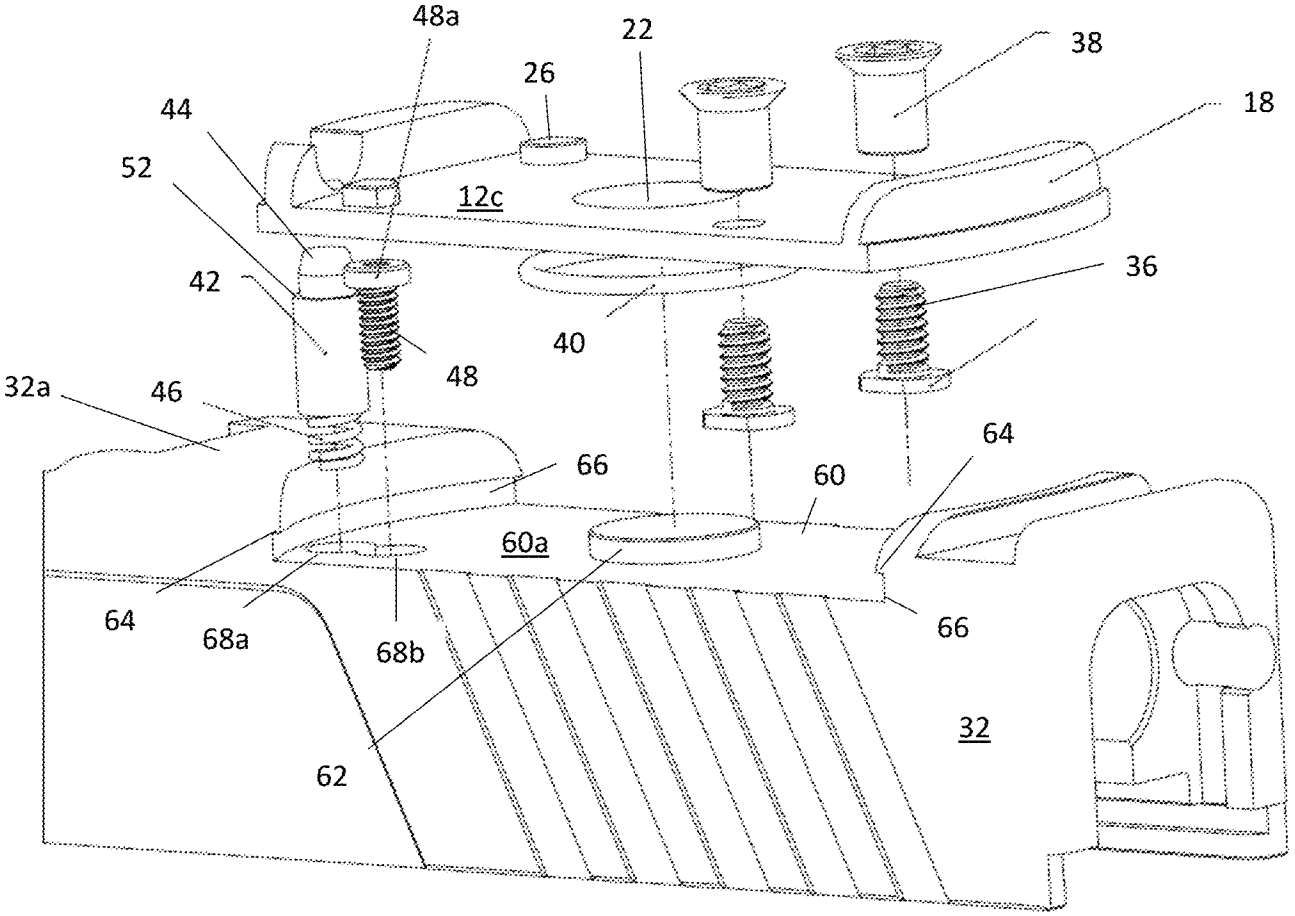
FIG. 5 depicts an exploded, downwards perspective view of an embodiment of the accessory mounting assembly of the present invention, showing the adaptor plate of FIG. 1 and accompanying pistol slide with exposed top surfaces.

FIG. 5 depicts an exploded, downwards perspective view of an embodiment of the accessory mounting assembly of the present invention, showing adaptor plate 10 with an exposed top surface 12*c*. Pistol slide 32 includes a recess portion 60 having a top planar surface 60*a* that is lower than top surface 32*a* of slide 32. Essentially, recess portion 60 represents a carve-out section of the slide 32, providing a lower accessory mounting position relative to slide top surface 32*a*. Approximately centered within slide recess portion 60 is pivot element 62, a circular cylinder or disc-shaped protrusion extending upwards from the top planar surface 60*a* of slide recess portion 60. Pivot element 62 serves as the pivot for the rotation of adaptor plate 10 when pivot element or disc-shaped protrusion 62 is inserted within aperture 22 prior to rotation of adaptor plate 10.

Slide recess portion 60 is terminated at each end by an overhang or lip 64 that extends inwards within the recess portion, in a longitudinal direction towards disc-shaped protrusion 62, such that a groove or slot 66 is formed at each end of recess portion 60. Grooves or slots 66 on each side of slide recess portion 60 are dimensioned to receive the adaptor plate flanges 16, 20, respectively, upon rotation of adaptor plate 10 about disc-shaped protrusion 62. Upon completion of rotation, overhangs or lips 64 act to secure adaptor plate 10, and once secured, prohibit adaptor plate 10 from lifting upwards relative to the top surface 60*a* of the slide recess portion 60.

Figure 6:
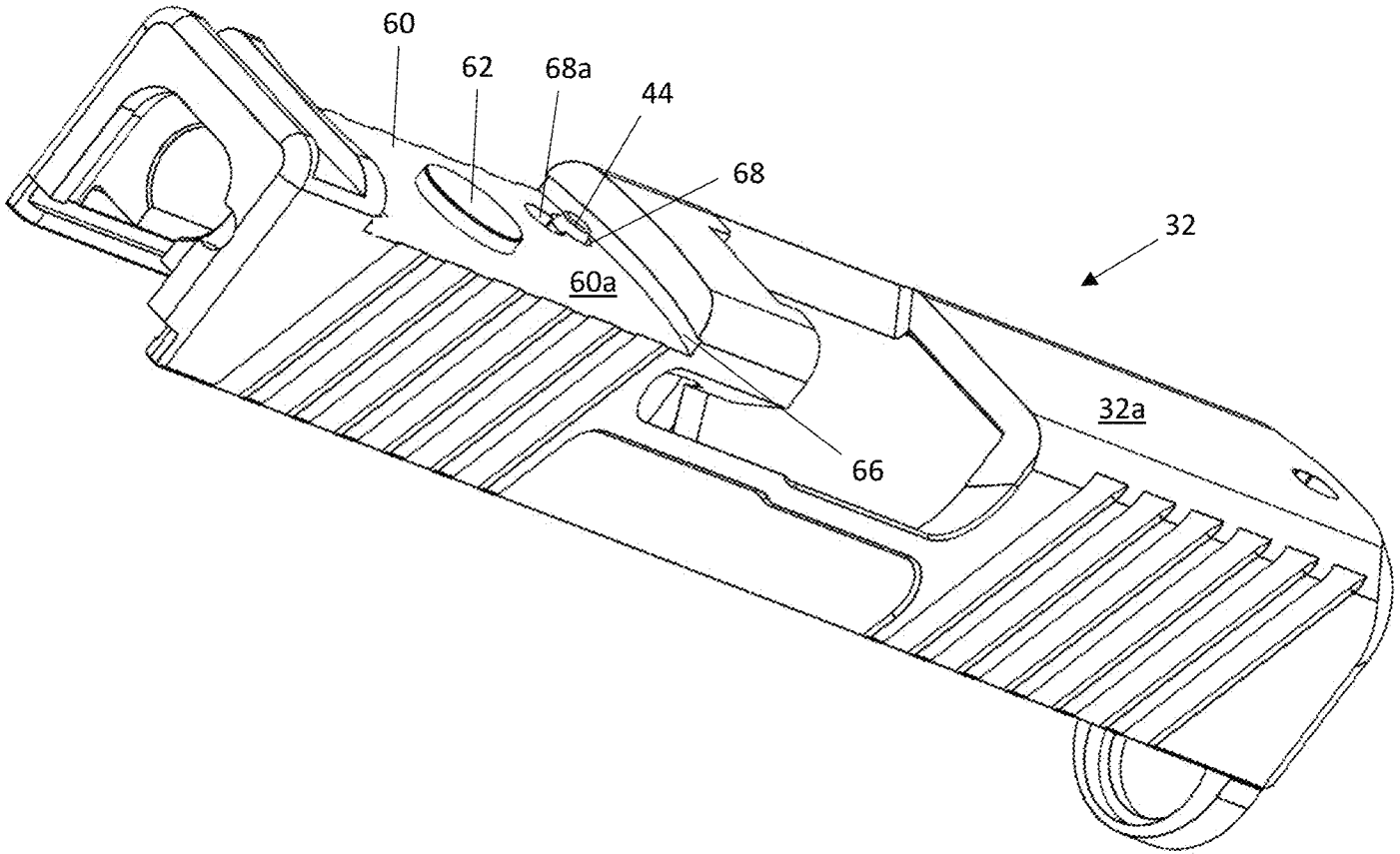
FIG. 6 depicts a right-side top perspective view of a pistol slide top surface where the top planar surface of a slide recess portion includes an eyelet having two overlapping or interconnecting apertures forward of an extended disc-shaped protrusion.

FIG. 6 depicts a right-side, top perspective view of slide 32, and more specifically the modifications to the slide top surface 32*a* at the recessed location. The top planar surface 60*a* of slide recess portion 60 includes at least one aperture or recessed indentation, shown in FIG. 6 as an eyelet 68 having two overlapping or interconnecting apertures 68*a,b* forward of disc-shaped protrusion 62. Apertures 68*a,b* each circumscribe a circular boundary except where they overlap. In at least one embodiment, the two overlapping, interconnecting apertures form a through-hole having an exposed shape on top planar surface 60*a* closely resembling a "figure-eight." Apertures 68*a,b* are designed to receive locking plunger pin 42 and low head retaining screw 48, such that upon installation, locking plunger pin head 44 extends, and is exposed above, slide recess portion top planar surface 60*a*.

Figure 7:
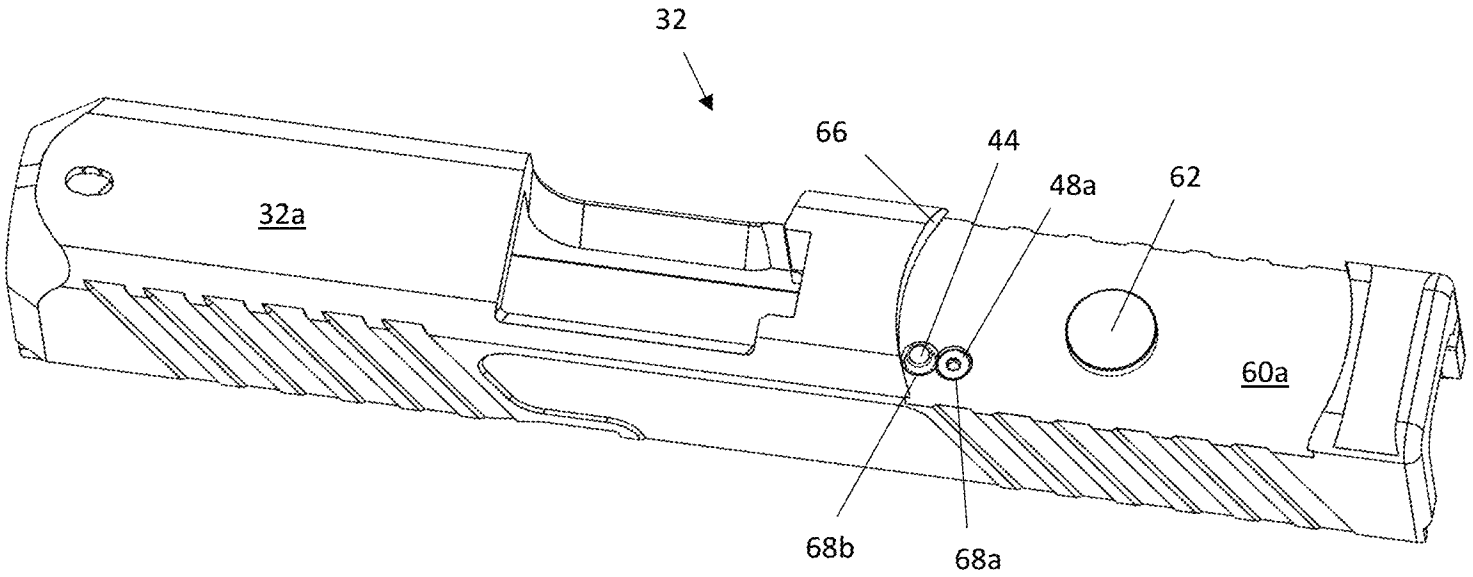
FIG. 7 depicts a left side top perspective view of the slide, exposing a locking plunger pin head extending above the slide recess portion top planar surface, being held in place by the head of a low head screw.

FIG. 7 depicts a left side, top perspective view of slide 32. In this view, locking plunger pin head 44 can be seen extending above slide recess portion top planar surface 60*a*, while low rising head 48*a* of low head retaining screw 48 secures locking plunger pin 42, limiting extension of the locking plunger pin head 44 from the slide recess portion top planar surface 60*a*, and retaining the locking plunger pin within the slide.

Figure 8A:
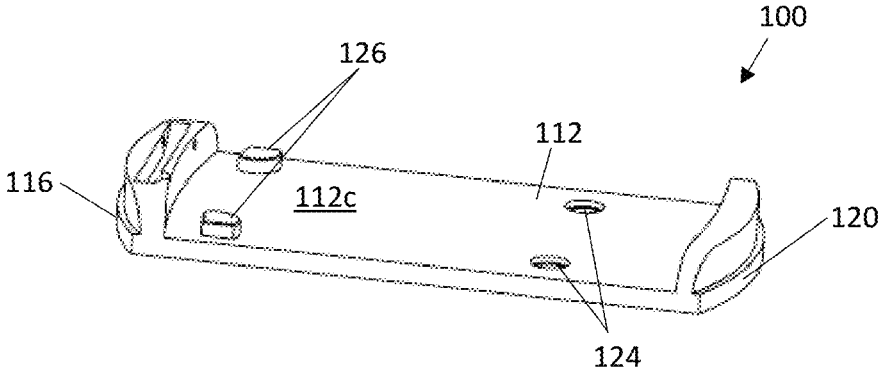
FIG. 8A depicts a top perspective view of a second embodiment of a rotatable mounting platform or adaptor plate of the present invention.

FIG. 8A depicts a top perspective view of a second embodiment of a rotatable mounting platform or adaptor plate 100 of the present invention. In this second embodiment, adaptor plate 100 does not have a center aperture for pivotable rotation; rather, the configuration of this plate is reversed from that of FIG. 1. The top surface 112*c* of adaptor plate 100 is solidly planar where the original center aperture 22 was previously located. The position of locator stud apertures 124 and protrusions 126 as shown on top surface 112*c* remain as indicated in the first embodiment.

Figure 8B:
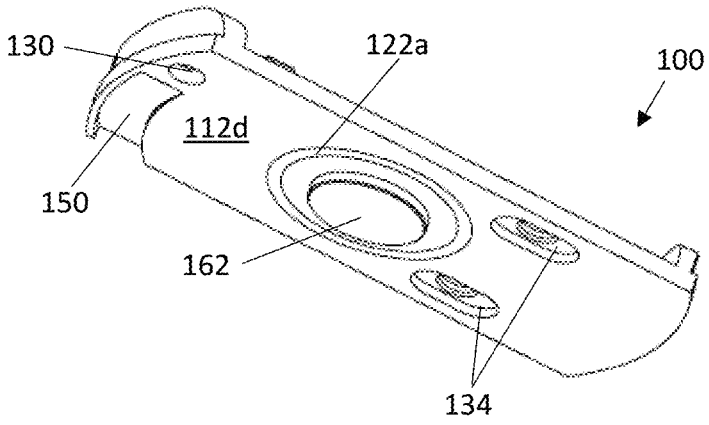
FIG. 8B depicts a bottom perspective view of the adaptor plate of FIG. 8A, showing a disc-shaped protrusion, which is utilized for pivoting the adaptor plate, extending downwards from the adaptor plate bottom surface.

FIG. 8B depicts a bottom perspective view of the adaptor plate 100 of FIG. 8A showing disc-shaped protrusion 162, which is utilized for pivoting the adaptor plate, extending downwards from the adaptor plate bottom surface 112*d*. Annular recess 122*a* is coaxial with the disc-shaped protrusion 162, and provides placement for an O-ring (not shown). The location of through-hole 130 and indentations 134 as shown on top surface 112*c* remain as indicated in the first embodiment.

Figure 9:
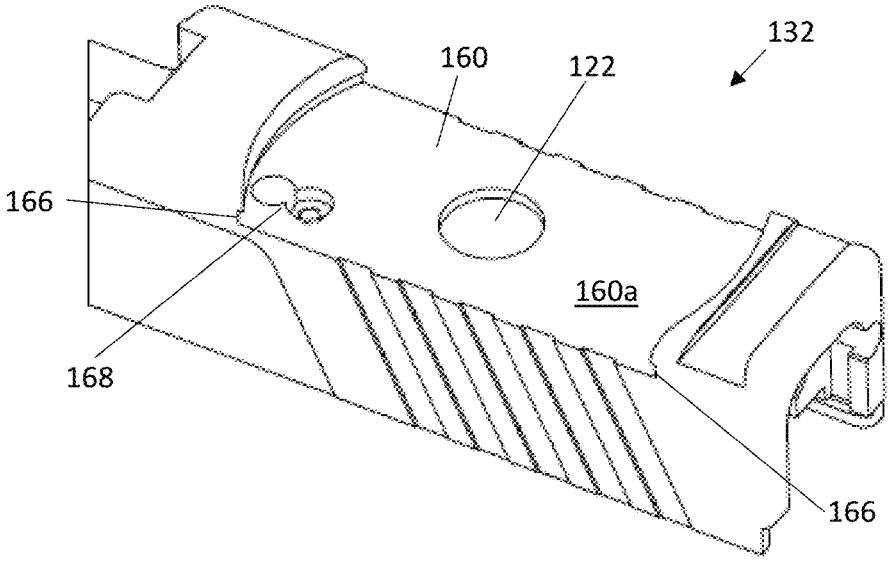
FIG. 9 depicts a top perspective view of a portion of the pistol slide of the second embodiment, showing a recess portion configured to receive the disc-shaped protrusion extending from the bottom surface of adaptor plate of FIG. 8B.

FIG. 9 depicts a top perspective view of a portion of pistol slide 132, showing recess portion 160 configured to receive the disc-shaped protrusion extending from the bottom surface of adaptor plate 100 of the second embodiment. Slide recess portion 160 having top surface 160*a* is formed with a disc-shaped indent or aperture 122 designed to receive disc-shaped protrusion 162 of adaptor plate 100. The pivoting mechanism of the disc-shaped protrusion and aperture is similar to that of adaptor plate 10 in the first embodiment, only the pivot and receiving aperture has now been reversed. The retaining grooves 166 of slide 132 are formed in a similar manner as the grooves 66 of pistol slide 32. Furthermore, the location of eyelet 168 remains the same as that depicted for eyelet 68 in the recess portion 60 of the first embodiment.

Referring to FIG. 5, locking plunger pin 42 has an outer diameter greater than that of locking plunger pin head 44 where the two structures meet. Locking plunger pin head 44 has a first cylindrical portion 44*a* that extends above the body of locking plunger pin 42, and tapers in decreasing diameter to form the head 44*b* (See FIG. 10). A shoulder 52 may be formed at the interface of locking plunger pin head cylindrical portion 44*a* and locking plunger pin body 42*a* due to the diametric differences in the two structures.

Figure 10:
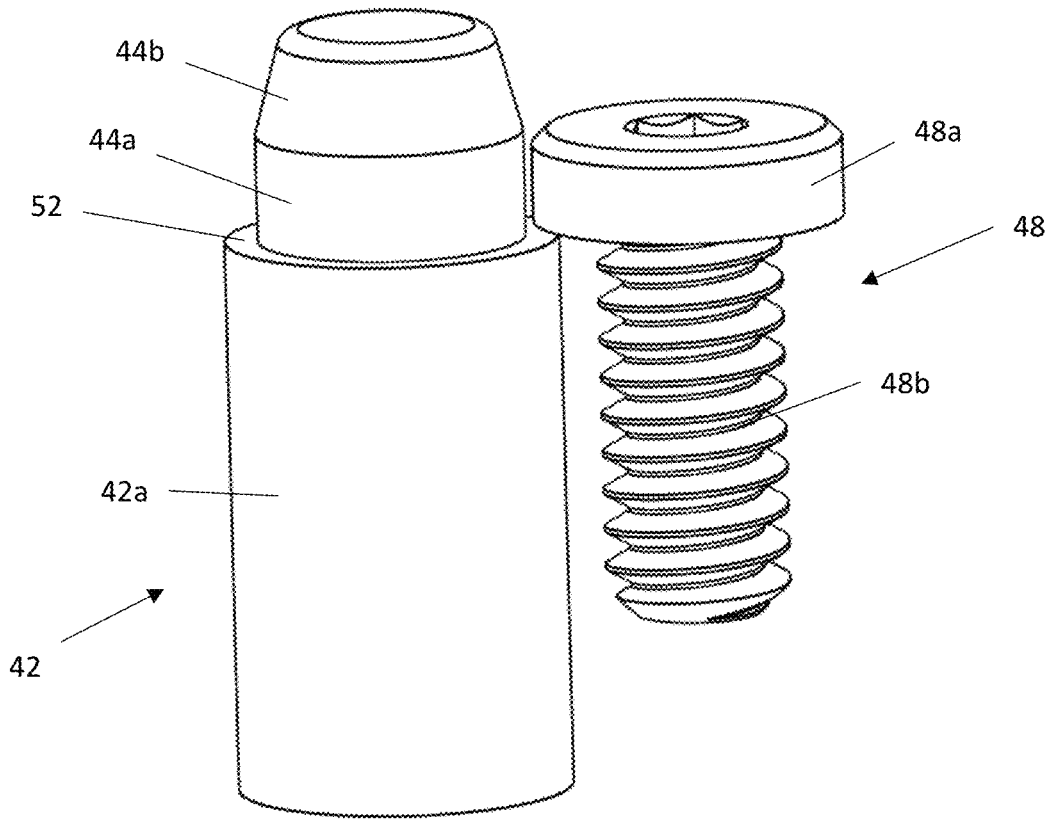
FIG. 10 depicts an exploded view of the locking plunger pin of FIGS. 2 and 5, and a low head retaining screw, illustrating the interaction therebetween.

FIG. 10 depicts an exploded view of the interaction between locking plunger pin 42 and low head retaining screw 48. Low head retaining screw 48 includes a low rising head 48*a* that extends beyond the threaded screw body 48*b* of low head retaining screw 48. Low rising head 48*a* of low head retaining screw 48 is dimensioned to overlap and engage shoulder 52 upon insertion of locking plunger pin 42 and low head retaining screw 48 through adaptor plate 10 eyelet 68, where locking plunger pin 42 is inserted within aperture 68*b* against a resilient counter force of compression spring 46, and low head retaining screw 48 is threaded into aperture 68*a*. Upon insertion of low head retaining screw 48, low rising head 48*a* overlaps shoulder 52 and retains locking plunger pin 42 from moving in a further direction upwards, holding locking plunger pin 42 against the upward force of compression spring 46. Once installed, locking plunger pin head 44*b* extends above slide recess portion top planar surface 60*a* but only to the extent that it is allowed by blocking low rising head 48*a*. Locking plunger pin body 42*a* may include a hollow portion 42*c* (see FIG. 11) to enclose compression spring 46. Upon installation, locking plunger pin 42 is able to retract below the bottom surface of low rising head 48*a* when locking plunger pin 42 is pressed downwards (inwards towards the slide) by ramp 50 of the bottom surface 12*d* during rotation of adaptor plate 10.

Figure 11:
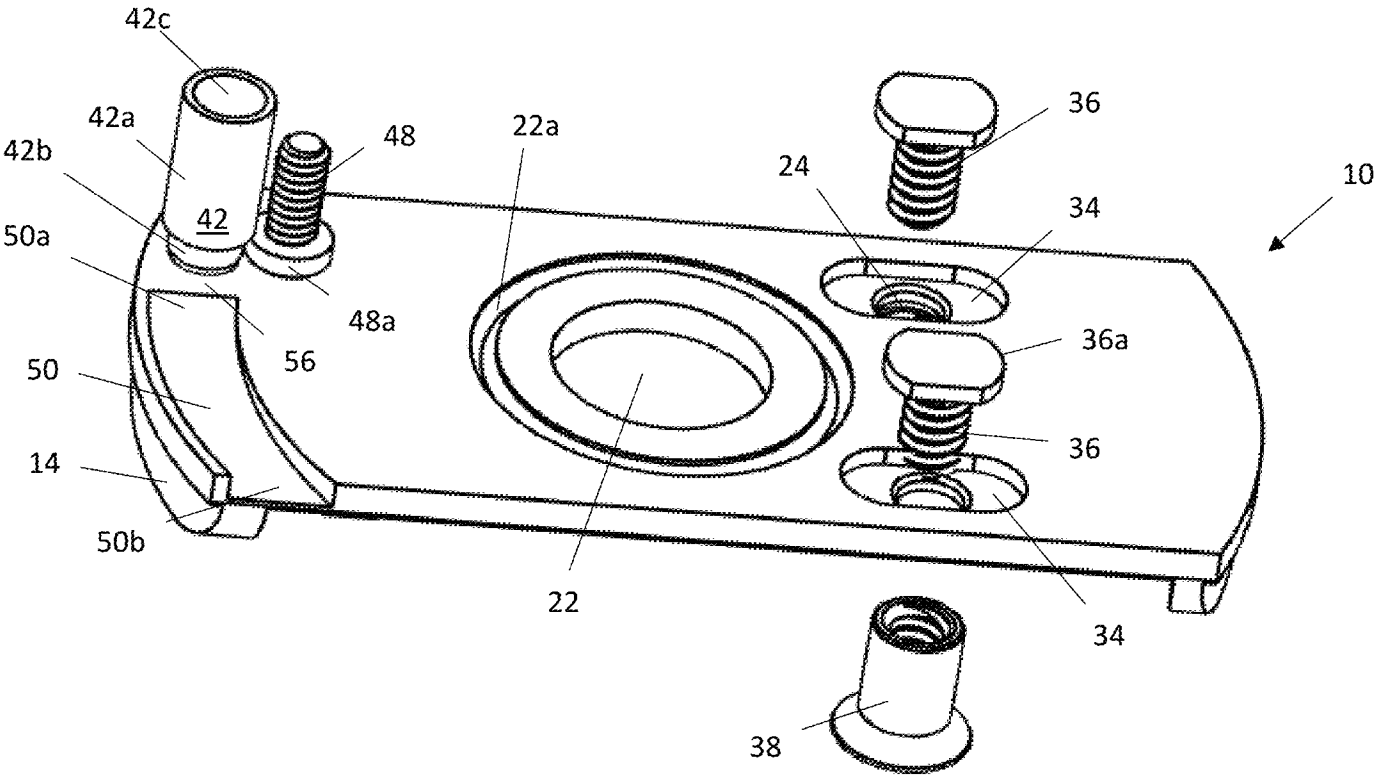
FIG. 11 depicts an exploded, bottom perspective view of adaptor plate of FIG. 1 showing the bottom side of the low head retaining screw with a low rising head contacting a shoulder of the locking plunger pin adjacent the locking pin plunger head, and locator studs 36 aligned for insertion within indentations within the adaptor plate bottom surface, and for connection with locator sleeves adjacent the adaptor plate top surface.

FIG. 11 depicts an exploded, bottom perspective view of adaptor plate 10 showing low rising head 48*a* contacting shoulder 52 of locking plunger pin 42. Hollow portion 42*c* is dimensioned to receive the compression spring, which supplies a force to the locking plunger pin against low rising head 48*a*.

Figure 12:
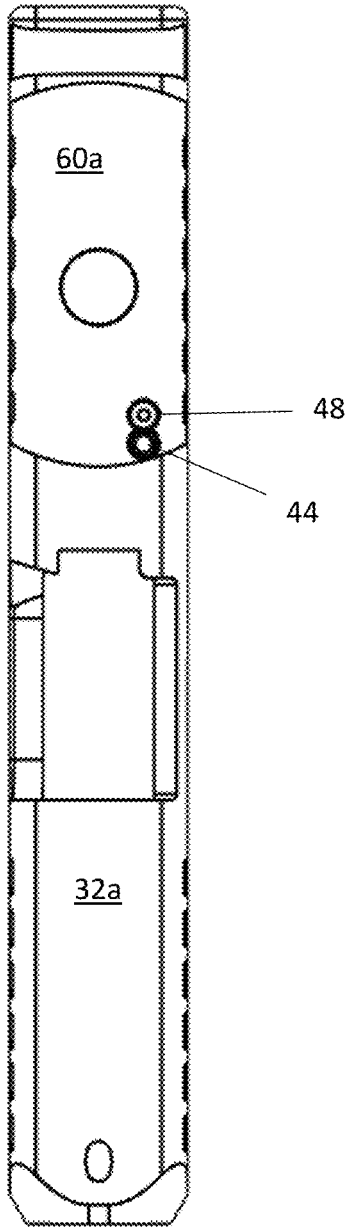
FIG. 12 is a top plan view of the pistol slide top surface, depicting the top planar surface of the slide recess portion, with the low head retaining screw overlapping the shoulder of the locking plunger pin, securing the locking plunger pin within the slide assembly, and exposing only the locking plunger pin head extending above the slide recess portion top surface.

FIG. 12 is a top plan view of slide top surface 32*a*, depicting top planar surface 60*a* of slide recess portion 60 with low head retaining screw 48 overlapping the shoulder 52 of locking plunger pin 42, securing locking plunger pin 42 within the slide assembly, and exposing only locking plunger pin head 44 above the slide recess portion top surface 60*a*.

Figure 13:
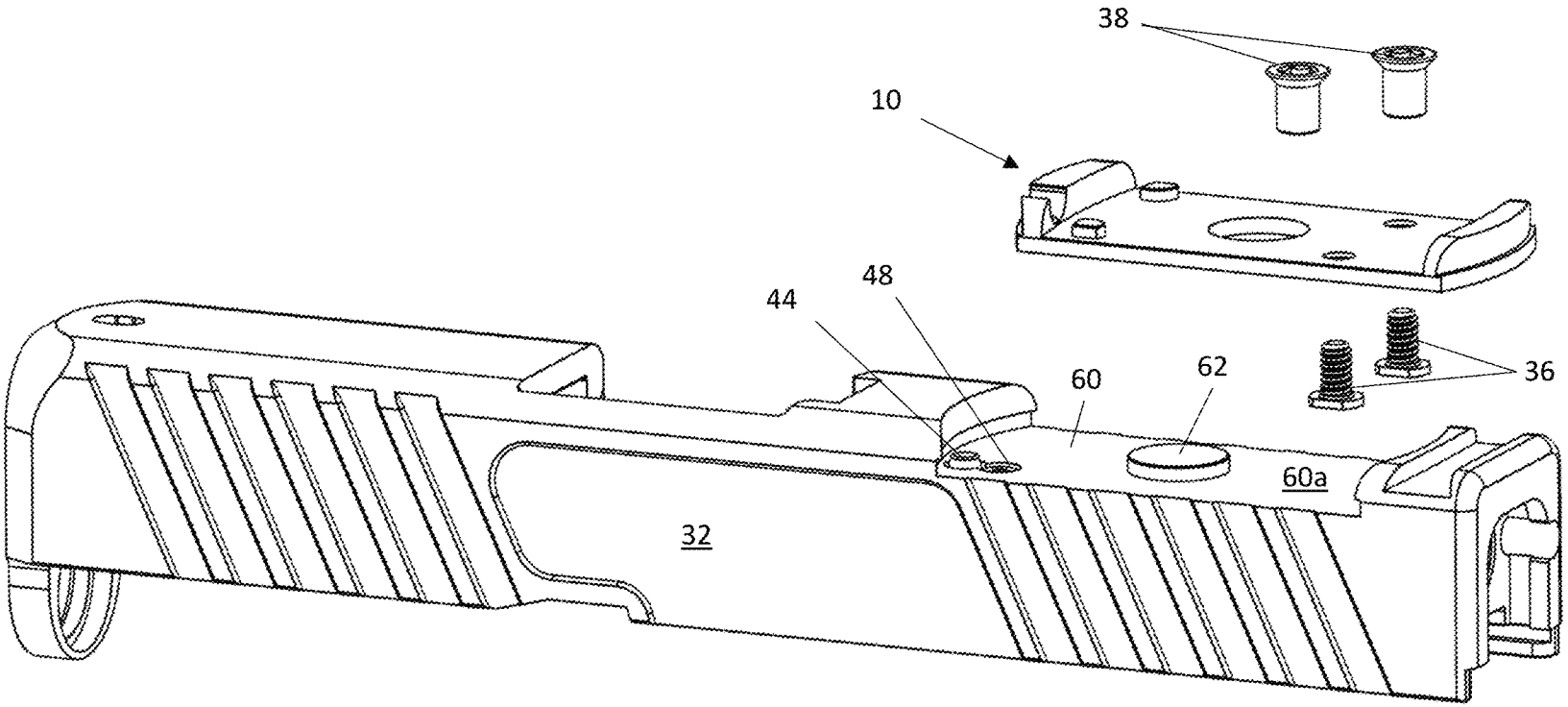
FIG. 13 is a top perspective, exploded view of the accessory mounting assembly showing the locking plunger pin head extending beyond the top planar surface of slide recess portion.

FIG. 13 is a top perspective, exploded view of the accessory mounting assembly showing the locking plunger pin head 44 extending beyond the top planar surface 60*a* of slide recess portion 60.

Figure 14:
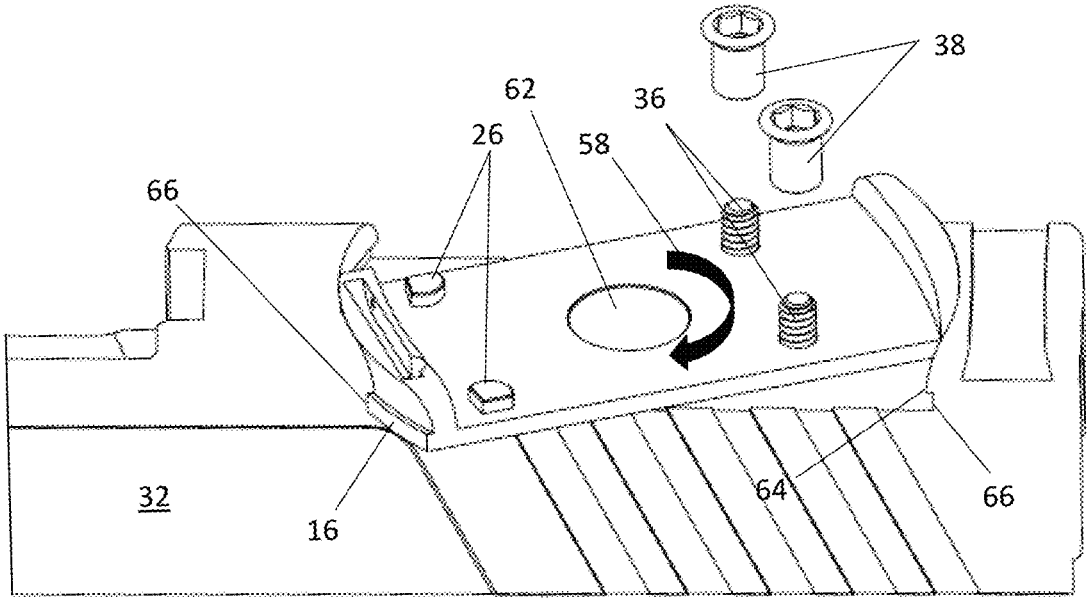
FIG. 14 is a top perspective, exploded view of the accessory mounting assembly during partial rotation, with the flanges of the adaptor plate inserted within formed grooves of the slide recess portion.

FIG. 14 is a top perspective, exploded view of the accessory mounting assembly during partial rotation. Adaptor plate 10 is shown sliding within grooves or slots 66 underneath overhangs or lips 64, which act to prevent upwards movement of adaptor plate 10. Upon rotation of adaptor plate 10 about disc-shaped protrusion 62 in the direction of arrow 58, flanges 16, 20 traverse within grooves 66 underneath overhangs or lips 64.

During initial rotation, the opening 50*b* at the longitudinal sidewall 12*a* of base section 12 slides over locking plunger pin head 44. As adaptor plate 10 continues to rotate to its locking position, the decreasing depth of ramp 50 continues to push locking plunger pin 42 further into slide 32 in a downwards motion. Once the rotation causes the inwardmost distance 50*a* of ramp 50 to contact the locking plunger pin head 44, the locking plunger pin head 44 within aperture 68*b* becomes fully depressed under a biasing compression force, and is approximately co-planar to the top planar surface 60*a* of slide recess portion 60. At this point in the rotation, locking plunger pin head 44 will contact the bottom planar surface 12*d* of base section 12 at a small planar section 56 adjacent through-hole 30. Subsequent rotation will move the adaptor plate 10 relative to the locking plunger pin head 44 towards aperture 30, where the upward force of compression spring 46 will cause locking plunger pin head 44 to extend within through-hole 30, locking adaptor plate 10 in place against any further rotation.

Figure 15:
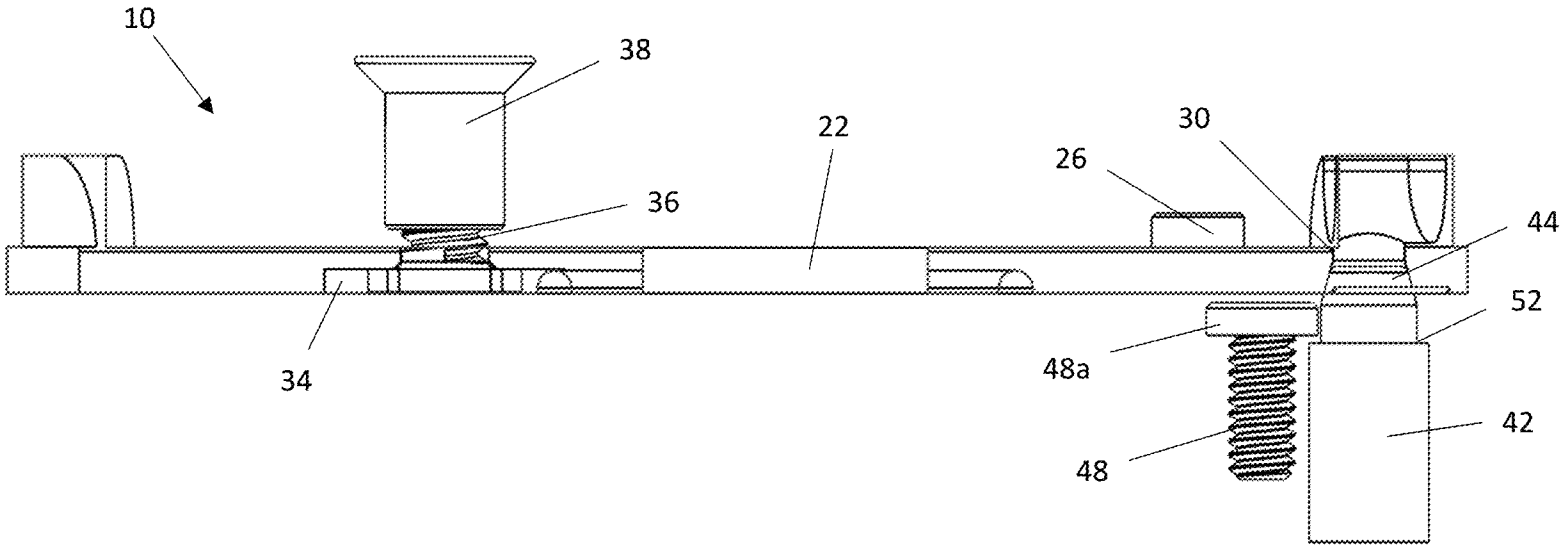
FIG. 15 depicts a side cross-sectional view of the adaptor plate, showing the low head retaining screw with a low rising head abutting the shoulder of the locking plunger pin, where the locking plunger pin head is depicted rising up through a through-hole in the adaptor plate, thereby securing the adaptor plate from further rotation.

FIG. 15 depicts an isolated, side cross-sectional view of adaptor plate 10, showing low head retaining screw 48 with low rising head 48*a* abutting shoulder 52 of locking plunger pin 42. Locking plunger pin head 44 is depicted rising up through through-hole 30, thereby securing adaptor plate 10 from further rotation.

Figure 16:
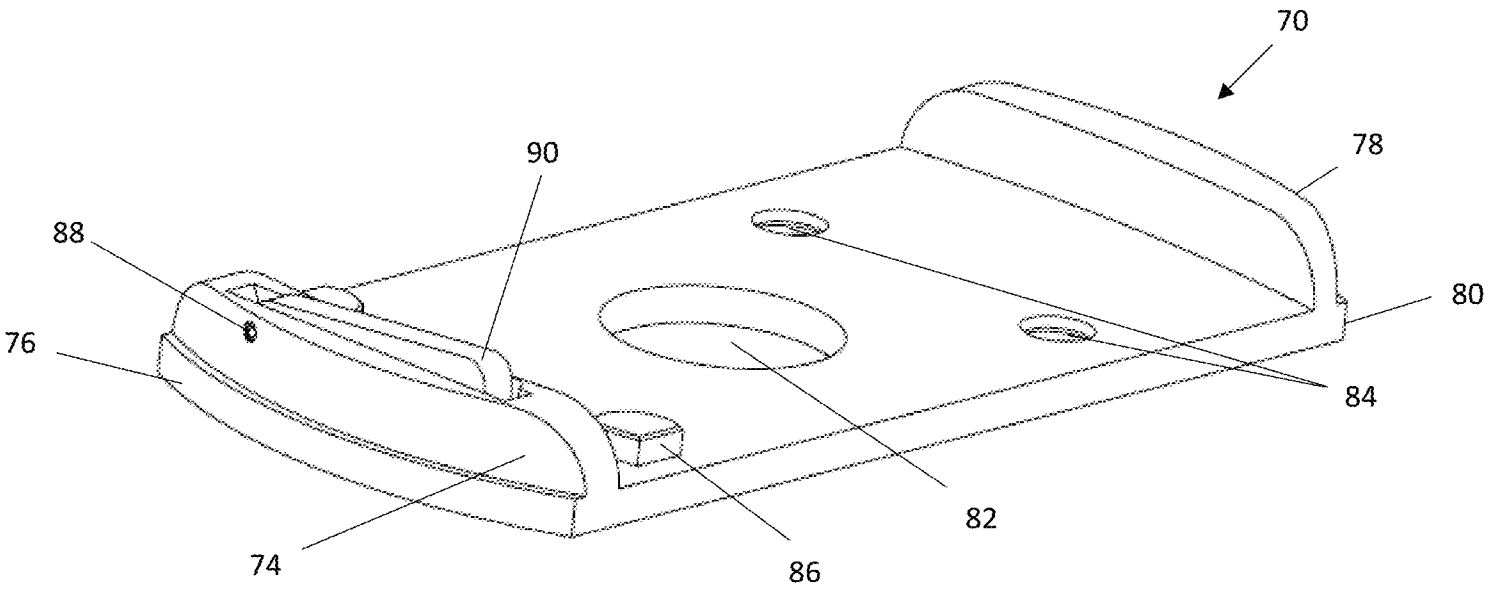
FIG. 16 depicts a second locking attachment embodiment of a rotatable adaptor plate of the present invention.

FIG. 16 depicts a second attachment embodiment of a rotatable adaptor plate of the present invention. As depicted in FIG. 16, adaptor plate 70 has similar attributes as adaptor plate 10, insomuch as breech side wall 78, apertures 84, center aperture 82, lugs or protrusions 86, and flanges 76, 80 are similar in design and function to the corresponding structures of adaptor plate 10. Forward sidewall 74 no longer has a cutout portion or gap; rather, a release lever pocket 88 is formed through the top surface of forward sidewall 74 to receive a rotatable release lever 90.

Figure 17:
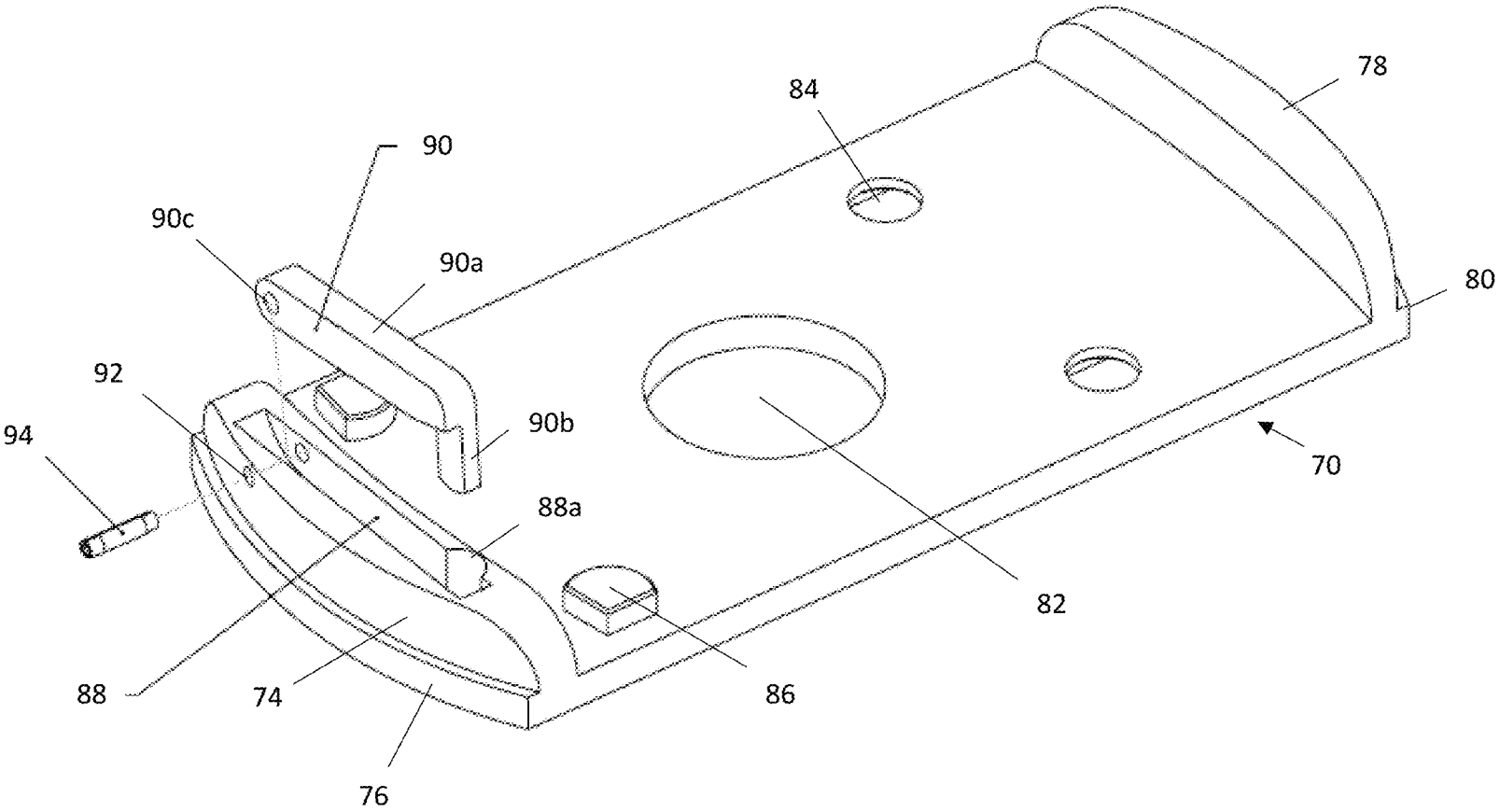
FIG. 17 is an exploded view of the attachment mechanism of adaptor plate of FIG. 16.

FIG. 17 is an exploded view of the attachment mechanism of adaptor plate 70 of FIG. 16. Release lever 90 is pivotable about pin 94, which is inserted in aperture 92 of forward sidewall 74. Pin 94 extends through an aperture 90*c* at the pivoting end of release lever 90. Release lever 90 includes an extended, downward facing segment or leg 90*b*, which in its operational configuration extends approximately perpendicularly downwards from laterally traversing lever arm 90*a*. At the location of segment or leg 90*b*, within release lever pocket 88, is a further indent 88*a* that is dimensioned to receive a portion of segment or leg 90*b*. Segment or leg 90*b* extends towards through-hole 100 (not shown), through forward sidewall 74, and abuts the locking plunger pin head. In order to release the locking plunger pin, release lever arm 90*a* is pressed downwards by a user, which causes leg 90*b* to press down on the locking plunger pin, depressing the locking plunger pin head from the through-hole aperture, thus enabling the adaptor plate to be rotated and removed.

Figure 18:
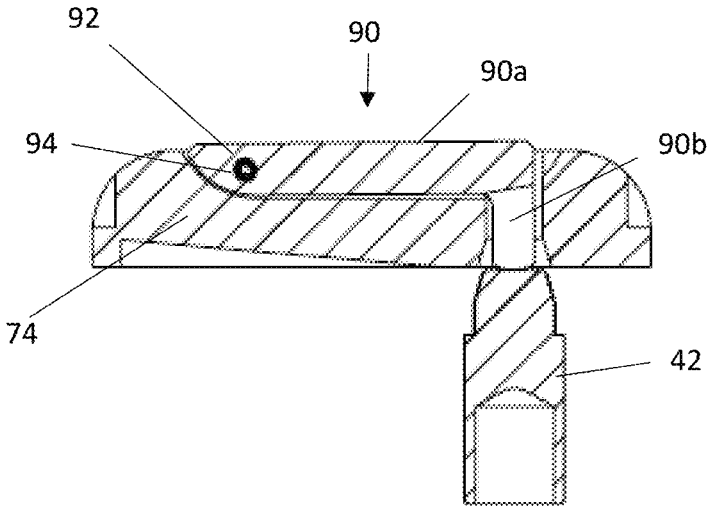
FIG. 18 depicts an isolated, cross-sectional side view of the sidewall of the adaptor plate of FIG. 16, showing segment or leg of the release lever in its activated position, extending through the through-hole and pushing the locking plunger pin downwards, such that the locking plunger pin head is below the top surface of the adaptor plate.

FIG. 18 depicts an isolated, cross-sectional side view of the sidewall 74 of adaptor plate 70 of FIG. 16, showing segment or leg 90*b* of release lever 90 in its activated position, extending through the through-hole and pushing the locking plunger pin 42 downwards, such that the locking plunger pin head is below the top surface of the adaptor plate.

Figure 19:
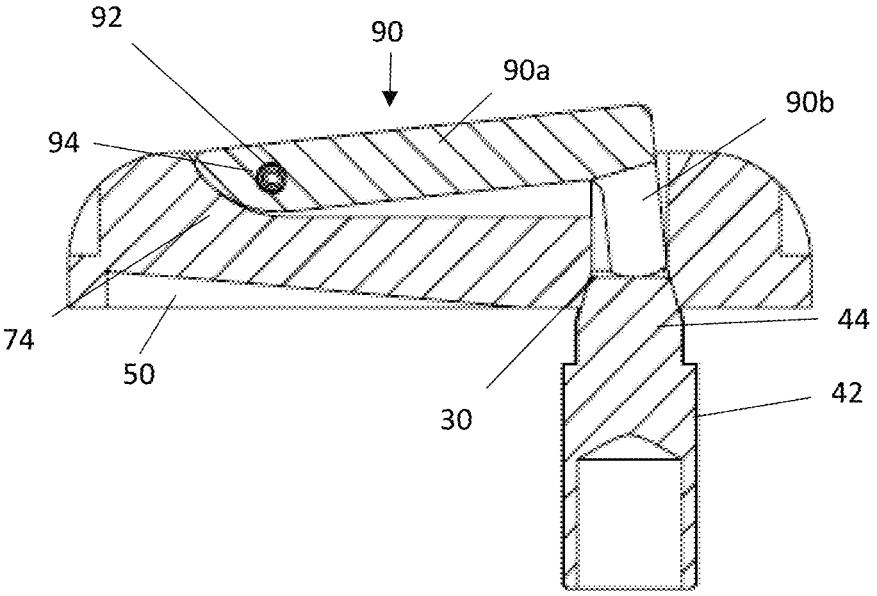
FIG. 19 is an isolated, cross-sectional side view of the sidewall of adaptor plate 70 of FIG. 16, when the adaptor plate is in the locked position.

FIG. 19 is an isolated, cross-sectional side view of the sidewall 74 of adaptor plate 70 of FIG. 16, when the adaptor plate is in the locked position. Locking plunger pin head 44 is shown inserted upwards through the through-hole 30, which in turn causes release lever 90 to pivot about pin 94, elevating release lever 90 from the horizontal position.

Based on the illustrative, exemplary embodiments identified above, the present invention allows for interchangeable, rotatably attachable adaptor plates, each of which can be mounted in advance to a desired accessory. The user has the ability to exchange one accessory for another by simply rotatably removing the adaptor plate from the firearm, and replacing with a new adaptor plate having a predetermined accessory already mounted thereon, or removing the accessory from the current adaptor plate and placing a new accessory thereon. In event of the latter, this may be an in-field transition that would not require the removal of any bolts or screws. Only the adaptor plate is attached to the firearm; the accessory being completely secured to the adaptor plate.

In yet another embodiment, if no accessory is desired for mounting, a firearm recess portion filler in the form of a plain adaptor plate 200 having no accessory mounting features may be utilized in place of the adaptor plate capable of holding an accessory.

Figure 20:
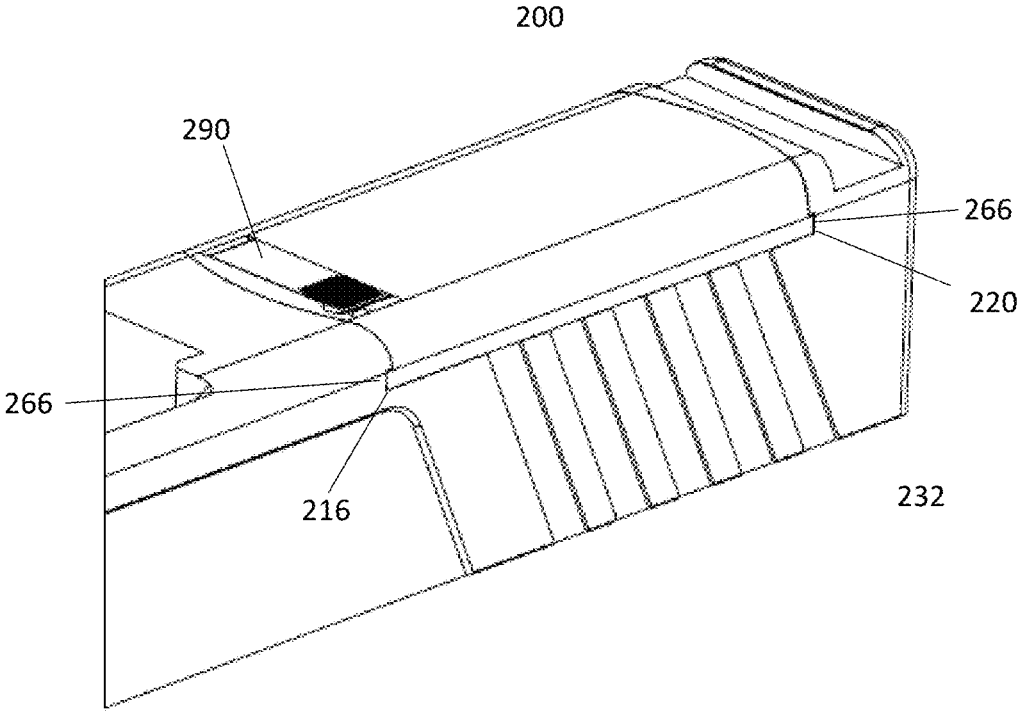
FIG. 20 depicts an embodiment of a plain adaptor plate absent any accessory mounting features, and utilized as a pistol slide recess portion filler.

FIG. 20 depicts an embodiment of a plain adaptor plate absent any accessory mounting features. The plain adaptor plate 200 requires for attachment opposing flanges 216, 220 for sliding into the grooves or slots 266 formed on the pistol slide 232. In the embodiment depicted, a release lever 290 is inserted in a pocket in the plate for a release mechanism that functions in a similar manner to that of the second embodiment discussed above. This adaptor plate could have a higher top surface, approximately equal in height as the pistol slide top surface, and may include a desirable description, name, drawing, trademark, or other identifying feature.

In a further embodiment of the present invention, a method of attaching a firearm accessory to a firearm is provided, where the method includes: a) attaching a firearm accessory to a rotatable adaptor plate, the adaptor plate having an aperture or a circular- or disc-shaped protrusion configured for pivoting; b) placing the adaptor plate into a recess portion of the frame of the firearm, where the recess portion has a complementary circular- or disc-shaped protrusion extending upwards from the recess portion for receiving the adaptor plate aperture, or a complementary aperture recessed within a planar surface of the recess portion for receiving the adaptor plate circular- or disc-shaped protrusion; c) pivoting the adaptor plate about the recess portion, thereby rotating a forward facing and breech facing flange of the adaptor plate into receiving grooves or slots formed at each end of the recess portion, where the receiving grooves or slots have an overhang or lip extending inwards with respect to said recess portion.

The adaptor plate aperture is approximately centered about the adaptor plate, and the adaptor plate aperture is in rotatable communication with the circular- or disc-shaped protrusion extending from the recess portion, such that the adaptor plate is rotatable about the recess portion.

Conversely, the adaptor plate circular- or disc-shaped protrusion is configured for pivoting, providing a pivot location for the adaptor plate, where the adaptor plate circular- or disc-shaped protrusion extends from a bottom surface of the adaptor plate and is configured to be received by a firearm recess portion complementary aperture, such that the adaptor plate is rotatable about the recess portion.

In yet another embodiment, a method of attaching a firearm accessory to a firearm includes the following:

a) placing an adaptor plate onto a recess portion of a frame of the firearm, the adaptor plate including: a top surface, a bottom surface, longitudinal sides, lateral sides shorter than the longitudinal sides, at least one locator stud aperture dimensioned for receiving a locator stud or mounting post, the at least one aperture located closer to a first edge of the adaptor plate, at least one protrusion or lug extending upwards from the adaptor plate top surface, the at least one protrusion or lug located closer to a second edge of the adaptor plate opposite the first edge, a center aperture for providing a pivot location for the rotatable adaptor plate, the center aperture located adjacent the at least one aperture and at least one protrusion or lug, such that the center aperture is approximately centered about the adaptor plate, a forward facing flange forming one edge of the adaptor plate; and a breech facing flange forming an opposite edge of the adaptor plate;

b) pivoting the adaptor plate about the center aperture when the adaptor plate is placed within the recess portion of the firearm frame, and the center aperture is in rotatably communication with a circular cylinder or disc-shaped protrusion extending from a top planar surface of the recess portion;

c) sliding the forward facing and the breech facing flanges into a groove or slot formed at each end of the recess portion, the groove or slot extending laterally across the frame, having a curvature, and having an overhang or lip extending inwards within the recess portion, towards the circular cylinder or disc-shaped protrusion, forming a top shelf for the groove or slot; and d) attaching the firearm accessory to the adaptor plate either before the adaptor place is placed onto the recess portion, or afterwards.

The method further including locking the adaptor plate from rotation by compressing a locking plunger pin upon rotation of the adaptor plate, and releasing the locking plunger pin into a receiving aperture of the adaptor plate when the rotation is complete.

Or, conversely, locking the adaptor plate from rotation by rotating a release lever having a stopping segment through an aperture in the adaptor plate and into an aperture within a top surface of the recess portion.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A rotatable accessory mounting assembly for rotatably mounting a firearm accessory to a firearm body, said mounting assembly comprising:

an adaptor plate having a top surface, a bottom surface, longitudinal sides, lateral sides shorter than said longitudinal sides, said adaptor plate including:

at least one locator stud aperture dimensioned for receiving a locator stud or mounting post;

a center aperture for providing a pivot location for said adaptor plate about which the adaptor plate is configured to rotate to be attached to the firearm, said center aperture located adjacent said at least one locator stud aperture, and approximately centered about said adaptor plate;

an annular recess concentric with said center aperture, and larger in diameter than said center aperture, said annular recess dimensioned to receive an O-ring;

a forward facing flange forming one edge of said adaptor plate; and a breech facing flange forming an opposite edge of said adaptor plate.

2. The firearm accessory mounting assembly of claim 1 including a through-hole aperture adjacent said forward facing flange or said breech facing flange.

3. The firearm accessory mounting assembly of claim 1 including on said adaptor plate bottom surface:

a nonround recess centered about each of said at least one locator stud apertures.

4. The firearm accessory mounting assembly of claim 3 including:

at least one locator stud for insertion within each of said at least one locator stud apertures, said locator stud having a nonround head for non-rotational placement within said nonround recess and a threaded post; and at least one locator sleeve for attachment to said threaded post of said at least one locator stud, such that each of said at least one locator studs is secured to said adaptor plate prior to rotational placement of said adaptor plate on a firearm structure.

5. The firearm accessory mounting assembly of claim 4 including a removable, reinstallable firearm accessory securable to said adaptor plate via said at least one locator stud.

6. The firearm accessory mounting assembly of claim 1 including an O-ring situated within said annular recess concentric with said center aperture.

7. The firearm accessory mounting assembly of claim 1 including a forward facing sidewall, said forward facing sidewall located adjacent said forward facing flange, and/or a breech facing sidewall, said breech-facing sidewall located adjacent said breech facing flange.

8. The firearm accessory mounting assembly of claim 7, wherein said forward facing sidewall and/or said breech facing sidewall includes a cut-out portion or gap.

9. The firearm accessory mounting assembly of claim 7 including a through-hole aperture adjacent said forward facing flange or said breech facing flange, such that said through-hole aperture traverses through at least a portion of said forward facing sidewall or said breech facing sidewall.

10. The firearm accessory mounting assembly of claim 9 including a recessed ramp exposed on said adaptor plate bottom surface, having sidewalls and a top wall, said recessed ramp extending in continuously decreasing depth from said longitudinal side, projecting laterally inwards towards said through-hole aperture.

11. The firearm accessory mounting assembly of claim 10, wherein said ramp extends laterally inwards, such that said recessed ramp initiates at an opening at said longitudinal sidewall, said recessed ramp having gradually decreasing depth as said recessed ramp progresses laterally inwards, such that said recessed ramp top wall approximately abuts said adaptor plate bottom surface.

12. The firearm accessory mounting assembly of claim 7 wherein said forward facing sidewall or said breech facing sidewall includes:

a release lever pocket traversing laterally across said forward facing sidewall or said breech facing sidewall;

a release lever rotatably insertable within said release lever pocket.

13. The firearm accessory mounting assembly of claim 12 wherein said release lever includes a downwardly extending segment, said segment forced downwards towards said through-hole when said release lever is rotated into said adaptor plate.

14. The firearm accessory mounting assembly of claim 1 including at least one protrusion or lug extending upwards from said adaptor plate top surface, said at least one protrusion or lug located closer to an edge of said adaptor plate.

15. A firearm comprising:

a frame having a top surface, longitudinal sides, and lateral sides shorter than said longitudinal sides;

a barrel and receiver assembly;

a recess portion in said frame having a planar top surface situated lower than said frame top surface, and interrupted by an approximately centered circular cylinder or disc-shaped protrusion extending from said recess portion top planar surface;

at least one aperture or recessed indentation located within said recess portion top planar surface;

an overhang or lip extending inwards within said recess portion forming a top shelf for a groove or slot formed at an end of said recess portion, said groove or slot extending laterally across said frame; and an adaptor plate having a top surface, a bottom surface, longitudinal sides, lateral sides shorter than said longitudinal sides, said adaptor plate including:

at least one locator stud aperture dimensioned for receiving a locator stud or mounting post;

a center aperture for providing a pivot location for said adaptor plate, said center aperture located adjacent said at least one locator stud aperture, such that said center aperture is approximately centered about said adaptor plate, said center aperture in rotatable communication with said circular cylinder or disc-shaped protrusion extending from said recess portion top planar surface, such that said adaptor plate is rotatable about said recess portion of said frame;

a forward facing flange forming one edge of said adaptor plate, or a breech facing flange forming an opposite edge of said adaptor plate, or both; and said forward facing and/or breech facing flanges respectively insertable within said groove or slot formed at a respective end of said recess portion upon rotation of said adaptor plate; and an annular recess concentric with said center aperture, and larger in diameter than said center aperture, said annular recess dimensioned to receive an O-ring.

16. The firearm of claim 15 including a firearm accessory releasably attachable to said adaptor plate.

17. The firearm of claim 15 including at least one protrusion or lug extending upwards from said adaptor plate top surface.

18. The firearm of claim 15 including a through-hole aperture adjacent said forward facing flange or said breech facing flange.

19. The firearm of claim 15 including on said adaptor plate bottom surface:

a nonround recess centered about each of said at least one locator stud apertures.

20. The firearm of claim 15 including:

at least one locator stud for insertion within each of said at least one locator stud apertures, said locator stud having a nonround head for non-rotational placement within said nonround recess, and a threaded post; and at least one locator sleeve for attachment to said threaded post of said at least one locator stud, such that each of said at least one locator studs is secured to said adaptor plate prior to rotational placement of said adaptor plate on a firearm structure.

21. The firearm of claim 15 including said O-ring situated within said annular recess concentric with said center aperture.

22. The firearm of claim 15 including a forward facing sidewall and/or a breech facing sidewall, said forward facing sidewall located adjacent said forward facing flange, said breech facing sidewall located adjacent said breech facing flange.

23. The firearm of claim 22 including a through-hole aperture adjacent said forward facing flange or said breech facing flange, such that said through-hole aperture traverses through said adaptor plate.

24. The firearm of claim 15 including a ramp exposed on said adaptor plate bottom surface, said ramp extending in a continuously decreasing depth from a longitudinal sidewall, projecting laterally inwards towards said through-hole aperture, such that a first depth of said ramp within said adaptor plate thickness coincides with an opening at said longitudinal sidewall, said ramp having gradually decreasing depth as said ramp progresses laterally inwards, such that said ramp has no appreciable depth at its inward-most distance from its origin at said longitudinal sidewall.

25. The firearm of claim 22 wherein said forward facing sidewall or said breech facing sidewall includes:

a release lever pocket traversing laterally across said forward facing sidewall or said breech facing sidewall;

a release lever rotatably insertable within said release lever pocket; and a pin for rotational pivot attachment of said release lever to said forward facing sidewall or said breech facing sidewall.

26. The firearm of claim 15 wherein said firearm is a pistol, and said frame is a pistol slide.

27. The firearm of claim 16 wherein said firearm accessory includes a telescopic sight, reflector sight, laser sight, night vision sight, thermal scope, range finder, and/or other secondary instruments.

28. A method of attaching a firearm accessory to a firearm, said method comprising:

attaching said firearm accessory to a adaptor plate, said adaptor plate having an aperture configured for pivoting;

placing said adaptor plate into a recess portion of a frame of said firearm, said recess portion having a complementary circular- or disc-shaped protrusion extending upwards from said recess portion for receiving said adaptor plate aperture;

pivoting said adaptor plate about said recess portion, thereby rotating a forward facing and breech facing flange of said adaptor plate into receiving grooves or slots formed at each end of said recess portion, said receiving grooves or slots having an overhang or lip extending inwards with respect to said recess portion; and locking said adaptor plate from further rotation by compressing a locking plunger pin upon rotation utilizing a recessed ramp exposed on an adaptor plate bottom surface, and having said locking plunger pin release into a receiving locking plunger pin aperture of said adaptor plate when said rotation is complete.

29. The method of claim 28 wherein said adaptor plate aperture is configured for pivoting, providing a pivot location for said adaptor plate, said adaptor plate aperture approximately centered about said adaptor plate, said adaptor plate aperture in rotatable communication with said circular- or disc-shaped protrusion extending from said recess portion, such that said adaptor plate is rotatable about said recess portion.

30. The method of claim 28 wherein said adaptor plate circular- or disc-shaped protrusion is configured for pivoting, providing a pivot location for said adaptor plate, said adaptor plate circular- or disc-shaped protrusion extending from a bottom surface of said adaptor plate configured to be received by said recess portion complementary aperture, such that said adaptor plate is rotatable about said recess portion.

31. A rotatable accessory mounting assembly for rotatably mounting a firearm accessory to a firearm body, said mounting assembly comprising:

an adaptor plate having a top surface, a bottom surface, longitudinal sides, lateral sides shorter than said longitudinal sides, said adaptor plate including:

at least one locator stud aperture dimensioned for receiving a locator stud or mounting post;

a center aperture for providing a pivot location about which said adaptor plate is configured to rotate, said center aperture located adjacent said at least one locator stud aperture, and approximately centered about said adaptor plate;

a forward facing flange forming one edge of said adaptor plate;

a breech facing flange forming an opposite edge of said adaptor plate;

a forward facing sidewall, said forward facing sidewall located adjacent said forward facing flange and extending upwards from said top surface, and/or a breech facing sidewall, said breech-facing sidewall located adjacent said breech facing flange and extending upwards from said top surface; and wherein said forward facing sidewall or said breech facing sidewall includes:

a release lever pocket traversing laterally across said forward facing sidewall or said breech facing sidewall; and a release lever rotatably insertable within said release lever pocket.

32. The firearm accessory mounting assembly of claim 31 wherein said release lever includes a downwardly extending segment, said segment forced downwards towards said through-hole when said release lever is rotated into said adaptor plate.

33. The firearm accessory mounting assembly of claim 31 including a through-hole aperture adjacent said forward facing flange or said breech facing flange, such that said through-hole aperture traverses through at least a portion of said forward facing sidewall or said breech facing sidewall.

34. The firearm accessory mounting assembly of claim 33 including a recessed ramp exposed on said adaptor plate bottom surface, having sidewalls and a top wall, said recessed ramp extending in continuously decreasing depth from said longitudinal side, projecting laterally inwards towards said through-hole aperture.

35. The firearm accessory mounting assembly of claim 34, wherein said ramp extends laterally inwards, such that said recessed ramp initiates at an opening at said longitudinal sidewall, said recessed ramp having gradually decreasing depth as said recessed ramp progresses laterally inwards, such that said recessed ramp top wall approximately abuts said adaptor plate bottom surface.

36. The firearm accessory mounting assembly of claim 31 including at least one protrusion or lug extending upwards from said adaptor plate top surface, said at least one protrusion or lug located closer to an edge of said adaptor plate.

37. A rotatable accessory mounting assembly for rotatably mounting a firearm accessory to a firearm body, said mounting assembly comprising:

an adaptor plate having a top surface, a bottom surface, longitudinal sides, lateral sides shorter than said longitudinal sides, said adaptor plate including:

at least one locator stud aperture dimensioned for receiving a locator stud or mounting post;

a center aperture for providing a pivot location for said adaptor plate about which the adaptor plate is configured to rotate to be attached to the firearm, said center aperture located adjacent said at least one locator stud aperture, and approximately centered about said adaptor plate;

a forward facing flange forming one edge of said adaptor plate;

a breech facing flange forming an opposite edge of said adaptor plate;

a through-hole aperture adjacent said forward facing flange or said breech facing flange, such that said through-hole aperture traverses through at least a portion of a forward facing sidewall or a breech facing sidewall; and a recessed ramp exposed on said adaptor plate bottom surface, having sidewalls and a top wall, said recessed ramp extending in continuously decreasing depth from said longitudinal side, projecting laterally inwards towards said through-hole aperture.

* * * * *